US006976901B1

(12) United States Patent
Halley et al.

(10) Patent No.: US 6,976,901 B1
(45) Date of Patent: Dec. 20, 2005

(54) IN SITU FEATURE HEIGHT MEASUREMENT

(75) Inventors: David G. Halley, Los Osos, CA (US); Greg Barbour, Atascadero, CA (US)

(73) Assignee: Strasbaugh, San Luis Obispo, CA (US)

( * ) Notice: Subject to any disclaimer, the term of this patent is extended or adjusted under 35 U.S.C. 154(b) by 41 days.

(21) Appl. No.: 10/681,047

(22) Filed: Oct. 7, 2003

Related U.S. Application Data

(63) Continuation-in-part of application No. 09/699,290, filed on Oct. 26, 2000, now Pat. No. 6,629,874, and a continuation-in-part of application No. 10/216,107, filed on Aug. 8, 2002, now Pat. No. 6,884,150, which is a continuation-in-part of application No. 10/146,494, filed on May 14, 2002, now Pat. No. 6,726,528.

(60) Provisional application No. 60/163,696, filed on Nov. 5, 1999, provisional application No. 60/161,705, filed on Oct. 27, 1999, provisional application No. 60/161,830, filed on Oct. 27, 1999, provisional application No. 60/161,707, filed on Oct. 27, 1999.

(51) Int. Cl.[7] ..... B24B 49/00
(52) U.S. Cl. ..... 451/6; 451/41; 451/285
(58) Field of Search ..... 451/5, 6, 8, 41, 451/285–289

(56) References Cited

U.S. PATENT DOCUMENTS 5,433,651 A * 7/1995 Lustig et al. ..... 451/6
5,643,060 A 7/1997 Sandhu et al.
5,664,987 A 9/1997 Renteln
5,792,709 A 8/1998 Robinson et al.
5,851,135 A 12/1998 Sandhu et al.
5,938,504 A 8/1999 Talieh
5,949,927 A * 9/1999 Tang ..... 385/12
5,953,115 A * 9/1999 Landers et al. ..... 356/237.2
6,000,996 A * 12/1999 Fujiwara ..... 451/6
6,022,807 A 2/2000 Lindsey, Jr. et al.
6,071,177 A * 6/2000 Lin et al. ..... 451/6
6,159,073 A * 12/2000 Wiswesser et al. ..... 451/6
6,190,234 B1 * 2/2001 Swedek et al. ..... 451/6
6,224,460 B1 * 5/2001 Dunton et al. ..... 451/6
6,280,289 B1 * 8/2001 Wiswesser et al. ..... 451/6
6,296,548 B1 * 10/2001 Wiswesser et al. ..... 451/8
6,383,058 B1 * 5/2002 Birang et al. ..... 451/41
6,485,354 B1 * 11/2002 Wolf ..... 451/6
6,506,097 B1 * 1/2003 Adams et al. ..... 451/5

OTHER PUBLICATIONS

"The Ellipsometer"; http://ece-www.colorado.edu/.about-.bart/book/ellipsom.htm.

* cited by examiner

*Primary Examiner*—M. Rachuba
(74) *Attorney, Agent, or Firm*—Townsend and Townsend and Crew LLP

(57) ABSTRACT

Embodiments of the invention provide methods and apparatus for in situ feature height measurement of an object being planarized. In one embodiment, a method of planarizing an object comprises polishing a surface of the object to be planarized using a polishing pad having a cavity; and directing an incident light from the cavity of the polishing pad to optically measure feature heights of surface features on the surface of the object to obtain measurement data during the polishing of the surface using the polishing pad. The feature heights are relative height differences of the features measured by directing the incident light at the surface of the object from the cavity and observing a reflected light intensity of a reflected light from the features on the surface to the cavity.

20 Claims, 17 Drawing Sheets

906
915
907
901
916
906
904
905
908
904
905
914
903
913
913
914
912
909
910
911
902
917
918

IN SITU FEATURE HEIGHT MEASUREMENT

CROSS-REFERENCES TO RELATED APPLICATIONS

This application is a continuation-in-part of U.S. patent application Ser. No. 09/699,290, filed Oct. 26, 2000 (now U.S. Pat. No. 6,629,874), which claims the benefit of U.S. Provisional Patent Application Nos. 60/161,705, 60/161,830, and 60/161,707, filed Oct. 27, 1999, and 60/163,696 filed Nov. 5, 1999. This application is also a continuation-in-part of U.S. patent application Ser. No. 10/216,107, filed Aug. 8, 2002, which is a continuation-in-part of U.S. patent application Ser. No. 10/146,494, filed May 14, 2002. The entire disclosures of the above patent applications are incorporated herein by reference.

BACKGROUND OF THE INVENTION

The present invention relates to the manufacture of electronic devices. More particularly, the invention provides a device for planarizing a film of material of an article such as a semiconductor wafer. In an exemplary embodiment, the present invention provides an improved substrate support for the manufacture of semiconductor integrated circuits. However, it will be recognized that the invention has a wider range of applicability; it can also be applied to flat panel displays, hard disks, raw wafers, MEMS wafers, and other objects that require a high degree of planarity.

The fabrication of integrated circuit devices often begins by producing semiconductor wafers cut from an ingot of single crystal silicon which is formed by pulling a seed from a silicon melt rotating in a crucible. The ingot is then sliced into individual wafers using a diamond cutting blade. Following the cutting operation, at least one surface (process surface) of the wafer is polished to a relatively flat, scratch-free surface. The polished surface area of the wafer is first subdivided into a plurality of die locations at which integrated circuits (IC) are subsequently formed. A series of wafer masking and processing steps are used to fabricate each IC. Thereafter, the individual dice are cut or scribed from the wafer and individually packaged and tested to complete the device manufacture process.

During IC manufacturing, the various masking and processing steps typically result in the formation of topographical irregularities on the wafer surface. For example, topographical surface irregularities are created after metallization, which includes a sequence of blanketing the wafer surface with a conductive metal layer and then etching away unwanted portions of the blanket metal layer to form a metallization interconnect pattern on each IC. This problem is exacerbated by the use of multilevel interconnects.

A common surface irregularity in a semiconductor wafer is known as a step. A step is the resulting height differential between the metal interconnect and the wafer surface where the metal has been removed. A typical VLSI chip on which a first metallization layer has been defined may contain several million steps, and the whole wafer may contain several hundred ICs.

Consequently, maintaining wafer surface planarity during fabrication is important. Photolithographic processes are typically pushed close to the limit of resolution in order to create maximum circuit density. Typical device geometries call for line widths on the order of 0.5 $\mu$m. Since these geometries are photolithographically produced, it is important that the wafer surface be highly planar in order to accurately focus the illumination radiation at a single plane of focus to achieve precise imaging over the entire surface of the wafer. A wafer surface that is not sufficiently planar, will result in structures that are poorly defined, with the circuits either being nonfunctional or, at best, exhibiting less than optimum performance. To alleviate these problems, the wafer is "planarized" at various points in the process to minimize non-planar topography and its adverse effects. As additional levels are added to multilevel-interconnection schemes and circuit features are scaled to submicron dimensions, the required degree of planarization increases. As circuit dimensions are reduced, interconnect levels must be globally planarized to produce a reliable, high density device. Planarization can be implemented in either the conductor or the dielectric layers.

In order to achieve the degree of planarity required to produce high density integrated circuits, chemical-mechanical planarization processes ("CMP") are being employed with increasing frequency. A conventional rotational CMP apparatus includes a wafer carrier for holding a semiconductor wafer. A soft, resilient pad is typically placed between the wafer carrier and the wafer, and the wafer is generally held against the resilient pad by a partial vacuum. The wafer carrier is designed to be continuously rotated by a drive motor. In addition, the wafer carrier typically is also designed for transverse movement. The rotational and transverse movement is intended to reduce variability in material removal rates over the surface of the wafer. The apparatus further includes a rotating platen on which is mounted a polishing pad. The platen is relatively large in comparison to the wafer, so that during the CMP process, the wafer may be moved across the surface of the polishing pad by the wafer carrier. A polishing slurry containing chemically-reactive solution, in which are suspended abrasive particles, is deposited through a supply tube onto the surface of the polishing pad.

CMP is advantageous because it can be performed in one step, in contrast to past planarization techniques which are complex, involving multiple steps. Moreover, CMP has been demonstrated to maintain high material removal rates of high surface features and low removal rates of low surface features, thus allowing for uniform planarization. CMP can also be used to remove different layers of material and various surface defects. CMP thus can improve the quality and reliability of the ICs formed on the wafer.

Chemical-mechanical planarization is a well developed planarization technique. The underlying chemistry and physics of the method is understood. However, it is commonly accepted that it still remains very difficult to obtain smooth results near the center of the wafer. The result is a planarized wafer whose center region may or may not be suitable for subsequent processing. Sometimes, therefore, it is not possible to fully utilize the entire surface of the wafer. This reduces yield and subsequently increases the per-chip manufacturing cost. Ultimately, the consumer suffers from higher prices.

It is therefore desirable to improve the useful surface of a semiconductor wafer to increase chip yield. What is needed is an improvement of the CMP technique to improve the degree of global planarity that can be achieved using CMP.

BRIEF SUMMARY OF THE INVENTION

The present invention achieves these benefits in the context of known process technology and known techniques in the art. The present invention provides an improved planarization apparatus for performing a planarization process, such as chemical mechanical planarization (CMP). Specifically, the present invention provides an improved planarization apparatus that provides multi-action CMP, such as orbital and spin action, and in situ monitoring and real-time feedback control to achieve uniformity during planarization. A planarization method for planarizing an object, such as a CMP process, comprises polishing a surface of the object to be planarized, and optically measuring feature heights of features on the surface of the object to obtain measurement data during said polishing of the surface.

In accordance with an aspect of the present invention, a method of planarizing an object comprises polishing a surface of the object to be planarized using a polishing pad having a cavity; and directing an incident light from the cavity of the polishing pad to optically measure feature heights of surface features on the surface of the object to obtain measurement data during the polishing of the surface using the polishing pad. The feature heights are relative height differences of the features measured by directing the incident light at the surface of the object from the cavity and observing a reflected light intensity of a reflected light from the features on the surface to the cavity.

In some embodiments, the polishing pad is larger in surface area than the surface of the object. The incident light is directed at the surface at an angle smaller than 90 degrees. The angle and wavelength of the incident light are selected based on the surface features. The feature heights are measured for a plurality of surface features and averaged to produce an average measurement. The method may further comprise adjusting, in real time, parameters controlling the polishing of the surface in response to the measurement data. The parameters include at least one of a spinning speed of the polishing pad around an axis of the polishing pad in contact with the surface of the object for polishing the surface, a rotational speed of the object around an axis of the object perpendicular to the surface to be planarized, a position of the polishing pad in contact with the surface of the object for polishing the surface, and a force between the polishing pad and the object. The reflected light from the features on the surface is oriented generally opposite from the incident light.

In accordance with another aspect of the invention, an apparatus for planarizing an object comprises a polishing pad having a cavity extending to a polishing surface used for polishing a surface of the object to be planarized; and an optical assembly disposed in the cavity of the polishing pad. The optical assembly is configured to direct an incident light from the cavity to the surface of the object an angle smaller than 90 degrees and to detect a reflected light from the surface of the object to the cavity to obtain optical measurement data.

In some embodiments, a controller is configured to adjust, in real time, parameters controlling the polishing of the surface in response to the optical measurement data. The optical assembly includes a surface which is substantially co-planar with the polishing surface of the polishing pad.

In accordance with another aspect of the present invention, an apparatus for planarizing an object comprises a polishing pad having a cavity extending to a polishing surface used for polishing a surface of the object to be planarized; and an optical assembly disposed in the cavity of the polishing pad. The optical assembly including a mechanism for directing an incident light from the cavity of the polishing pad to optically measure feature heights of surface features on the surface of the object to obtain measurement data during the polishing of the surface using the polishing pad. The feature heights are relative height differences of the features measured by directing the incident light at the surface of the object from the cavity and observing a reflected light intensity of a reflected light from the features on the surface to the cavity.

DETAILED DESCRIPTION OF THE INVENTION

Figure 1:
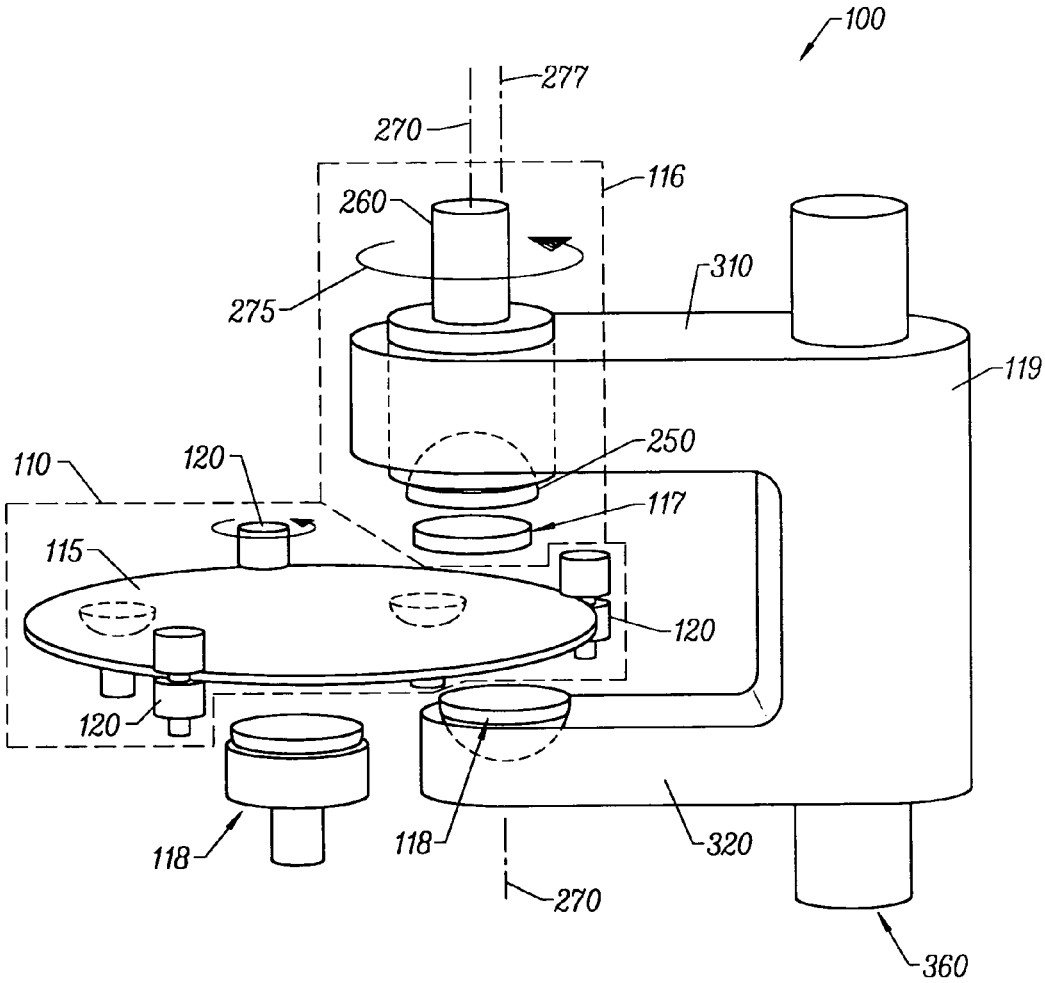
FIG. 1 is a simplified diagram of a sub-aperture planarization apparatus according to an embodiment of the present invention.

FIG. 1 is a simplified diagram of a planarization apparatus 100 according to an embodiment of the present invention. In this apparatus 100, the polishing pad is smaller, typically substantially smaller, in surface area than the substrate being planarized. Such an apparatus is referred to herein as a sub-aperture apparatus. The term full-aperture is used to describe a planarization apparatus in which the polishing pad is larger in surface area than the substrate being planarized. The diagram of FIG. 1 is merely an example, which should not limit the scope of the claims herein. One of ordinary skill in the art would recognize many other variations, modifications, and alternatives. In a specific embodiment, planarization apparatus 100 is a chemical-mechanical planarization apparatus.

Wafer Guide and Spin Assembly

The apparatus 100 includes an edge support, or a guide and spin assembly 110, that couples to the edge of an object, or a wafer 115. While the object in this specific embodiment is a wafer, the object can be other items such as a in-process wafer, a coated wafer, a wafer comprising a film, a disk, a panel, etc. Guide assembly 110 supports and positions wafer 115 during a planarization process. FIG. 1 also shows a polishing pad assembly 116 having a polishing pad 117, and a back-support 118 attached to a dual arm 119. Pad assembly 116, back support 117, dual arm 118 is described in detail below.

In a specific embodiment, guide assembly 110 includes rollers 120, each of which couples to the edge of wafer 115 to secure it in position during planarization. The embodiment of FIG. 1 shows three rollers. The actual number of rollers, however, will depend on various factors such as the shape and size of each roller, the shape and size of the wafer, and nature of the roller-wafer contact, etc. Also, at least one of the rollers 120 drives the wafer 115, that is, cause the wafer to rotate, or spin. The rest can serve as guides, providing support as the wafer is polished. The rollers 120 are positioned at various points along the wafer perimeter. As shown in FIG. 1, the rollers 120 attach to the wafer 115 at equidistant points along the wafer perimeter. The rollers 120 can be placed anywhere along the wafer perimeter. The distance between each roller will depend on the number of rollers, and on other factors related to the specific application.

Figure 1A:
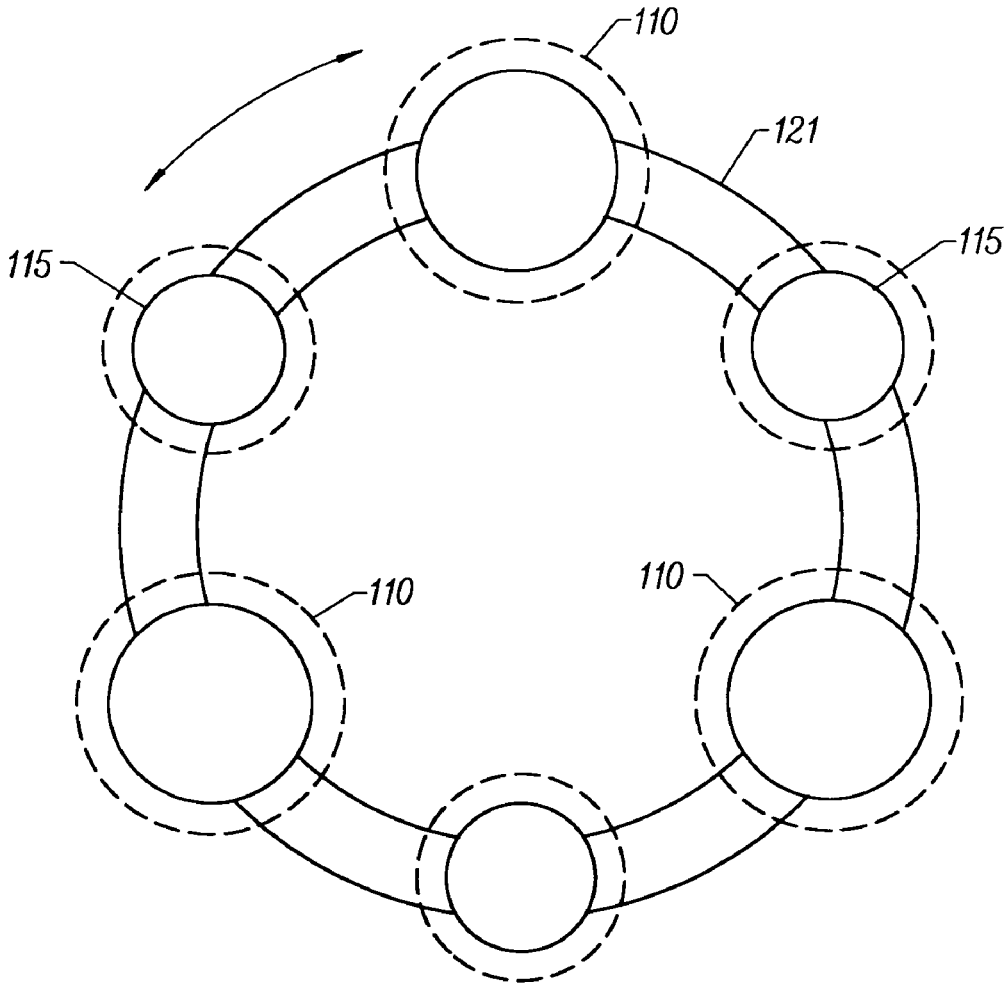
FIG. 1A is a simplified top-view diagram of a carousel for supporting multiple guide and spin assemblies according to an embodiment of the present invention.

The embodiment of FIG. 1 shows one guide and spin assembly 110. The actual number of such assemblies will depend on the specific application. For example, FIG. 1A shows a simplified top-view diagram of a carousel 121 for supporting multiple guide and spin assemblies 110 for processing multiple wafers 115 according to an embodiment of the present invention. In this specific embodiment, the carousel (FIG. 1A) can be used with multiple guide assemblies for planarizing many wafers. The actual size, shape, and configuration of the carousel will depend on the specific application. Also, when multiple guide assemblies are used, all guide assemblies need not be configured identically. The configuration of each guide assembly will depend on the specific application. For higher throughput, wafers are mounted onto the guide assemblies that are in cue during the planarization of one or more of the other wafers. For even higher throughput, such wafer carousels are configured to operatively couple to multiple planarization apparatus.

Figure 2:
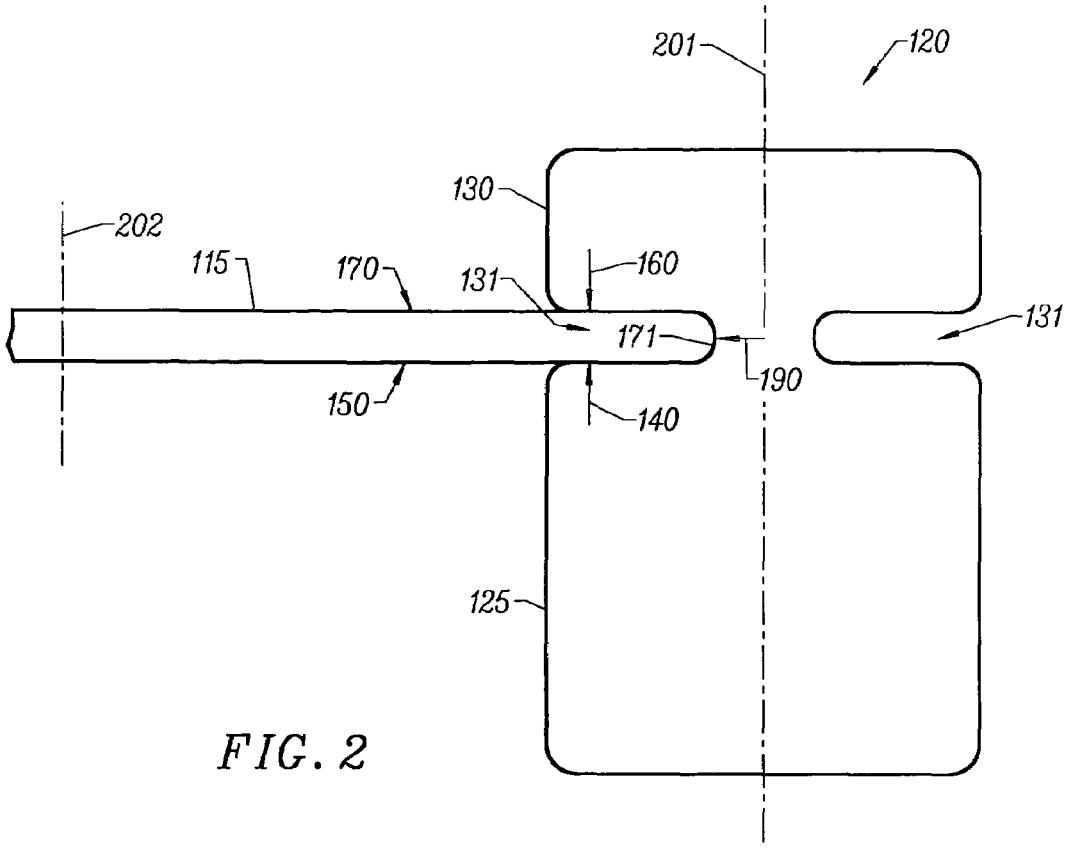
FIG. 2 is a detailed diagram of a guide and spin roller according to an embodiment of the present invention.

FIG. 2 is a detailed diagram of a roller 120 of FIG. 1 according to an embodiment of the present invention. This diagram is merely an example, which should not limit the scope of the claims herein. One of ordinary skill in the art would recognize many other variations, modifications, and alternatives. As shown, each roller 120 has a base portion 125, a top portion 130, and an annular notch 131 extending completely around the roller, and positioned between the base and top portions. The depth and shape of notch 131 will vary depending on the purpose of the specific roller. A roller designated to drive the rotation of the wafer might have a deeper notch to provide for more surface area contact with the wafer 115. Alternatively, a roller designated to merely guide the wafer might have a shallower notch, having enough depth to provide adequate support.

Figure 2A:
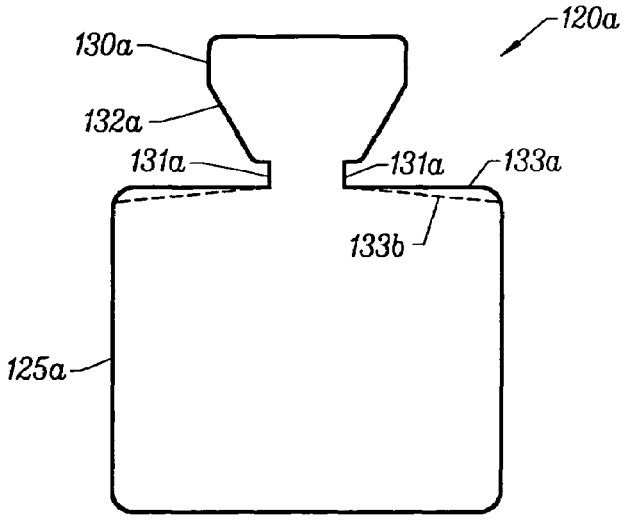
FIG. 2A is a diagram of a guide and spin roller according to another embodiment of the present invention.

FIG. 2A shows another roller 120*a* having a base portion 125*a* similar to the base portion 125 of FIG. 2. The top portion 130*a* has a smaller cross-section that the top portion 130 of FIG. 2, and desirably includes a tapered or inclined surface 132*a* tapering down to an annular notch 131*a* which is more shallow than the notch 131 of FIG. 2. The shallow notch 131*a* is sufficient to connect the roller 120*a* to the edge of the wafer 115. The top portion 130*a* and the shallow notch 131*a* make the engagement of the roller 120*a* with the edge of the wafer 115 easier. The replacement of the wafer 115 can also be performed more readily and quickly since the roller 120*a* with the smaller to portion 130*a* need not be retracted as far as the roller 120 of FIG. 2. The surface 133*a* of the bottom portion 125*a* may also be inclined by a small degree (e.g., about 1–5°) as indicated by the broken line 133*b* to further facilitate wafer engagement.

The edge of wafer 115 is positioned in the notch of each roller such that the process side of wafer 115 faces polishing pad 117. To secure wafer 115, the base portion of each roller provides an upward force 140 against the back side 150 of the wafer while the top portion provides a downward force 160 against the process surface 170 (side to be polished) of the wafer. For additional support, the inner wall 171 of the notch provides an inward force 190 against the wafer edge. The top and base portions 130, 125 constitute one piece. Alternatively, the top and base portions 130, 125 can include multiple pieces. For example, the top portion 130 can be a separate piece, such as a screw cap or other fastening device or the equivalent. Each roller 120 has a center axis 201 and each can rotate about its axis. Rotation can be clockwise or counterclockwise. Rotation can also accelerate or decelerate.

Guide and spin assembly 110 also has a roller base (not shown) for supporting the rollers. The size, shape, and configuration of the base will depend on the actual configuration of the planarization apparatus. For example, the base can be a simple flat surface that is attached to or integral to the planarization apparatus. The base can support some of the rollers, while at least one roller need to be retractable sufficiently to permit insertion and removal of the wafer 115, and need to be adjustable relative to the edge of the wafer 115 to control the force applied to the edge of the wafer 115.

In operation, during planarization, guide assembly 110 can move wafer 115 in various ways relative to polishing pad 117. For example, the guide assembly can move the wafer laterally, or provide translational displacement, in a fixed plane, the fixed plane being substantially parallel to a treatment surface of polishing pad 117 and back support 118. The guide assembly can also rotate, or spin, the wafer in the fixed plane about the wafer's axis. As a result, the guide assembly 110 translates the wafer 115 in the x-, y-, and z-directions, or a combination thereof. During actual planarization, that is when a polishing pad contacts the wafer, the guide assembly can move the wafer laterally in a fixed plane. The guide assembly can translate the wafer in any number of predetermined patterns relative to the polishing pad. Such a predetermined pattern will vary and will depend on the specific application. For example, the pattern can be substantially radial, linear, etc. Also, at least when the polishing pad contacts the object during planarization, such a pattern can be continuous or discontinuous or a combination thereof.

Conventional translation mechanisms for x-, y-, z-translation can control and traverse the guide assembly. For example, alternative mechanisms include pulley-driven devices and pneumatically operated mechanisms. The guide assembly and the wafer can traverse relative to the polishing pad in a variety of patterns. For example, the traverse path can be radial, linear, orbital, stepped, etc. or any combination depending on the specific application. The rotation direction of the wafer can be clockwise or counter clockwise. The rotation speed can also accelerate or decelerate.

Still referring to FIG. 2, as indicated above, in addition to lateral movement, the guide assembly can also rotate, or spin, wafer 115 in the fixed plane about the wafer center axis 202. The fixed plane is substantially parallel to a treatment surface of polishing pad 117. One way to provide rotational movement is by using rollers 120 described above. As mentioned above, at least one roller rotates about its center axis to drive the wafer to rotate about its center axis. The other rollers can also drive the wafer to rotate. They can also rotate freely. As said, each roller can rotate about its center axis 201 in either a clockwise or counterclockwise direction. The wafer will rotate in the opposite direction of the driving roller.

Specifically, as one or more of the driving rollers spin along their rotational axis 201 during operation, the friction between the inner walls of notch 131 and the wafer edge cause wafer 115 to rotate along its own axis 202. The roller itself can provide the friction. For example, the notch can include ribs, ridges, grooves, etc. Alternatively, a layer of any known material having a sufficient friction coefficient, such as a rubber or polyamide material, can also provide friction. One of ordinary skill in the art would recognize many other variations, modifications, and alternatives. For example, each roller can be movably or immovably fixed to a base (not shown) and a wheel within the notch of each roller can spin, causing the wafer to spin.

To rotate, or spin, the wafer, one or more conventional drive motors (not shown) or the equivalent can be operatively coupled to the wafer, rollers, or roller base. The drive can be coupled to one or more of the rollers via a conventional drive belt (not shown) to spin the wafer. Alternatively, the drive can also couple to the guide assembly such that the entire guide assembly rotates about its center axis thereby causing the wafer to rotate about the guide assembly center axis. With all embodiments, the motor can be reversible such that the rotation direction 275 (FIG. 1) of the polishing pad 117 about its axis 270 can be clockwise or counter clockwise. Drive motor can also be a variable-speed device to control the rotational speed of the pad. Also, the rotational speed of the pad can also accelerate or decelerate depending on the specific application.

Alternatively, the edge support can also be stationary during planarization while a polishing pad rotates or moves laterally relative to the wafer. This variation is described in more detail below. During planarization, such movement occurs in the fixed plane at least when the polishing pad 117 contacts the wafer. During any part of or during the entire planarization process, any combination of the movements described above is possible.

Referring to FIG. 1, planarization apparatus 100 also includes a polishing head, or polishing pad assembly 116, for polishing wafer 115. Pad assembly 116 includes polishing pad 117, a polishing pad chuck 250 for securing and supporting polishing pad 117, and a polishing pad spindle 260 coupled to chuck 250 for rotation of pad 117 about its axis 270. According to a specific embodiment, the pad diameter is substantially less than the wafer diameter, typically 20% of the wafer diameter.

To rotate, or spin, the wafer, one or more conventional drive motors (not shown) or the equivalent can be operatively coupled to polishing pad spindle 260 via a conventional drive belt (not shown). The motor can be reversible such that the rotation direction 275 of polishing pad 117 can be clockwise or counter clockwise. Drive motor can also be a variable-speed device to control the rotational speed of the polishing pad. Also, the rotational speed of the polishing pad can also accelerate or decelerate depending on the specific application.

Polishing and Back Support Assembly

The planarization apparatus also includes a base, or dual arm 119. While the base can have any number of configurations, the specific embodiment shown is a dual arm. Pad assembly 116 couples to back support 118 via dual arm 119. Dual arm 119 has a first arm 310 for supporting pad assembly 116 and a second arm 320 for supporting back support 118. The arms 310, 320 may be configured to move together or, more desirably, can move independently. The arms 310, 320 can be moved separately to different stations for changing pad or puck and facilitate ease of assembling the components for the polishing operation.

According to a specific embodiment of the invention, back support 118 tracks polishing pad 117 to provide support to wafer 115 during planarization. This can be accomplished with the dual arm. In a specific embodiment, the pad assembly 116 attaches to first arm 310 and back support 118 attaches to second arm 320. Dual arm 119 is configured to position the pad assembly 116 and back support 118 such that a support surface of back support 118 faces the polishing pad 117 and such that the support surface of back support 118 and polishing pad 117 are substantially planar to one another. Also, according to the present invention, the centers of the polishing pad and surface of the back support are precisely aligned. This precision alignment allows for predicable and precise planarization. Precision alignment is ensured when the first and second arms constitute one piece. Alternatively, both arms can include multiple components and may be movable independently. As such, the components are substantially stable such that the precision alignment is maintained.

Specifically, according to one embodiment, dual arm 119 supports pad assembly 116 such that spindle 260 passes rotatably through first arm 310 towards back support 118 which is supported by second arm 320. The rotational axis 270 of the pad 117 is equivalent to that of the spindle 260. Rotational axis 270 is positioned to pass through back support 118, preferably through the center of the back support 118. Pad assembly 116 is configured for motion in the direction of wafer 115. FIG. 1 shows the process surface of the wafer positioned substantially horizontally and facing upwardly.

According to a specific embodiment of the present invention, the entire planarization system can be configured to polish the wafer in a variety of positions. During planarization, for example, the dual arm 119 can be positioned such that the wafer 115 is controllably polished in a horizontal position or a vertical position, or in any angle. These variations are possible because the wafer 115 is supported by rollers 120 rather than by gravity. Such flexibility is useful in, for example, a slurry-less polish system.

In operation, dual arm 119 can translate pad assembly 116 relative to wafer 115 in a variety of ways. For example, the dual arm 119 can pivot about the pivot shaft to traverse the pad 117 radially across the wafer 115. In another embodiment, both arms 310 and 320 can extend telescopically (not shown) to traverse the pad laterally linearly across the wafer 115. Both radial and linear movements can also be combined to create a variety of traversal paths, or patterns, relative to the wafer 115. Such patterns can be, for example, radial, linear, orbital, stepped, continuous, discontinuous, or any combination thereof. The actual traverse path will of course depend on the specific application.

Figure 3:
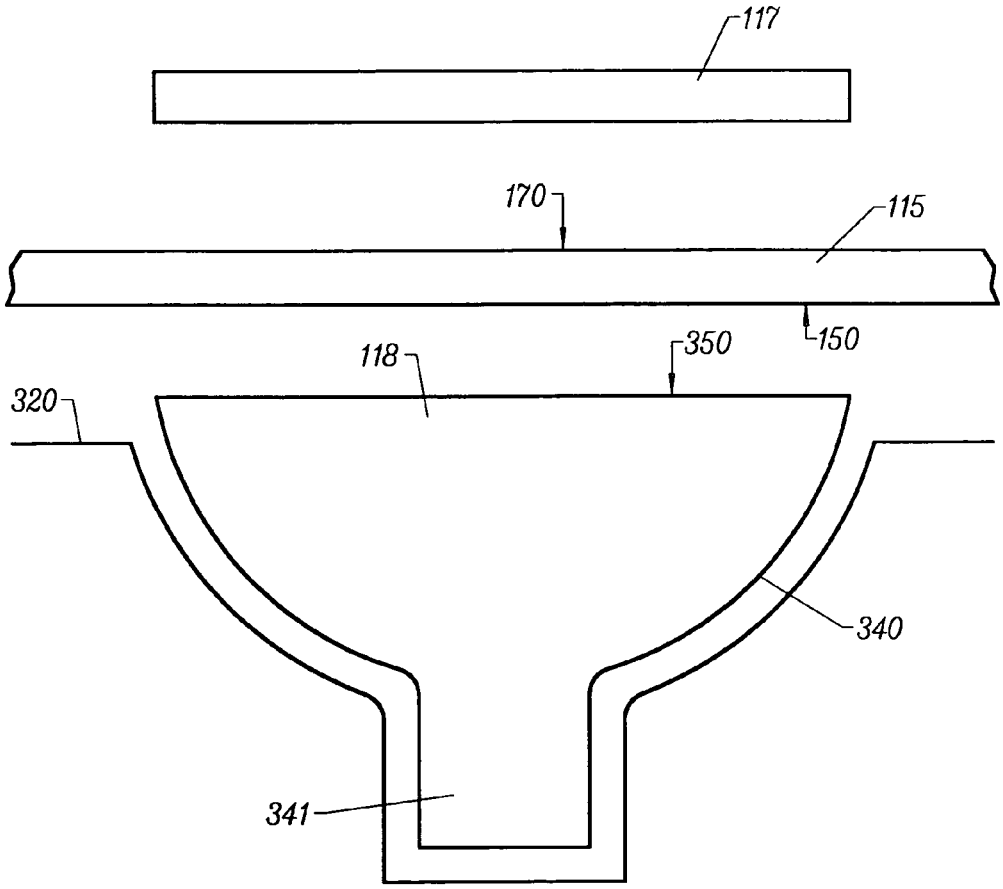
FIG. 3 is a detailed diagram of a polish pad back support according to an embodiment of the present invention.

FIG. 3 is a detailed diagram of back support 118 of FIG. 1 according to an embodiment of the present invention. This diagram is merely an example, which should not limit the scope of the claims herein. One of ordinary skill in the art would recognize many other variations, modifications, and alternatives. Back support 118 supports wafer 115 during planarization. Specifically, back support 118 dynamically tracks polishing pad 117 to provide local support to wafer 115 during planarization. Such local support eliminates wafer deformation due to the force of the polishing pad against the wafer during planarization. This also results in uniform polishing and thus planarity. In a specific embodiment, the back support 118 operatively couples to the pad assembly 116 via the dual arm 119. In a specific embodiment, the back support 118 is removably embedded in second arm 320 of the dual arm. Referring to FIG. 1, rotational axis 270 of polishing pad 117 and spindle 260 pass through back support 118.

Referring back to FIG. 3, back support 118 can be configured in any number of ways for supporting wafer 115 during planarization. In a specific embodiment, back support 118 has a flat portion, or support surface 350, that contacts the back side 150 of the wafer during planarization. The support surface 350 desirably provides a substantially friction free interface between surface 350 and back side 150 of the wafer by using a low-friction solid material such as Teflon. Alternatively, the support surface 350 may support a fluid bearing as the frictionless interface with the back side 150. The fluid may be a gas such as air or a liquid such as water, which may be beneficial for serving the additional function of cleaning the back side 150 of the wafer. This friction free interface allows the wafer to move across the surface of the back support.

Support surface 350 is substantially planar with the wafer 115 and pad 117. The diameter of the surface should be large enough to provide adequate support to the object during planarization. In a specific embodiment, the back support surface has a diameter that is substantially the same size as the polishing pad diameter. In FIG. 3, the back support 118 shown is a spherical air bearing and has a spherical portion 340 allowing it to be easily inserted into second arm 320. The rotation of the spherical portion 340 relative to the second arm allows the back support 118 to track the polishing pad 117 and support the wafer 115 with the support surface 350. The back support 118 in FIG. 3 has a protrusion 341 into a cavity of the second arm. The protrusion 341 may serve to limit the rotation of the back support 118 relative to the second arm 320 during tracking of the polishing pad 117. In an alternate embodiment, the back support 118 may be generally hemispherical without the protrusion.

The process surface 170 of the wafer 115 faces the pad 117 and the back side 150 of the wafer 115 faces the back support 118. Also, the wafer 115 is substantially planar with both the pad 117 and back support 118. In another embodiment, the back support 118 can be replaced with a second polishing pad assembly for double-sided polishing. In such an embodiment, the second pad assembly can be configured similarly to the first pad assembly on the first arm. The polishing pads of each are substantially planar to one another and to the wafer 115.

In a specific embodiment, the back support is a bearing. In this specific embodiment, the bearing can be a low-friction solid material (e.g., Teflon), an air bearing, a liquid bearing, or the equivalent. The type of bearing will depend on the specific application and types of bearing available.

Figure 3A:
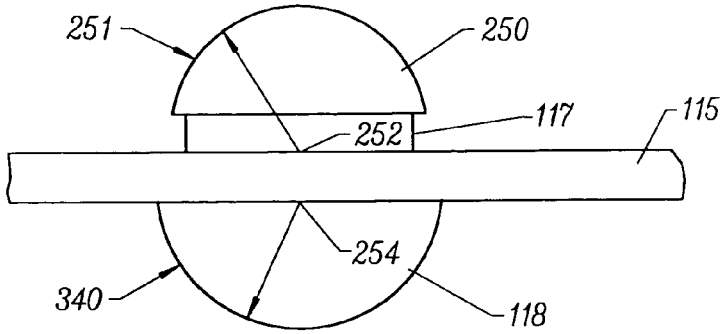
FIG. 3A is a simplified diagram of a support mechanism for supporting the wafer with projected gimbal points according to an embodiment of the present invention.
Figure 3B:
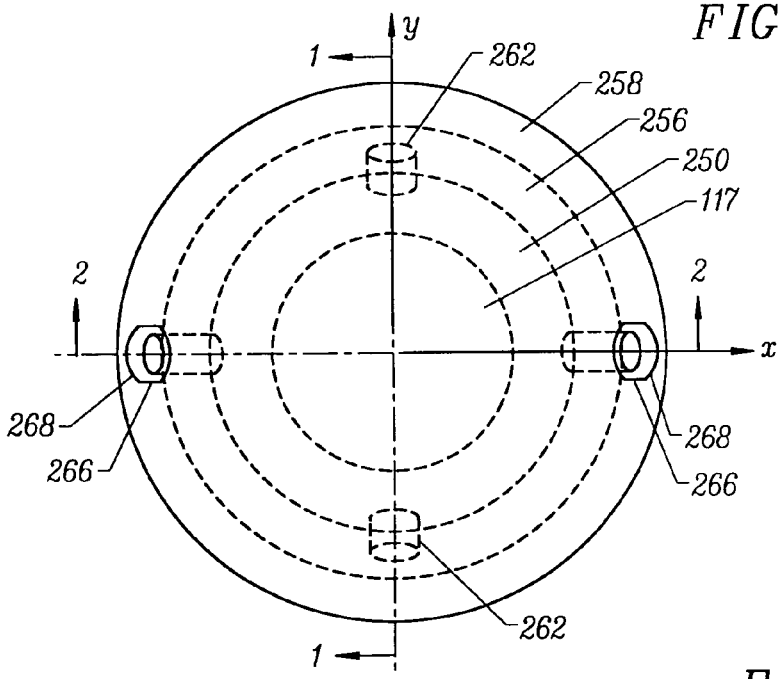
FIG. 3B is a top plan view of a gimbal drive support for the polishing pad with project gimbal point.
Figure 3C:
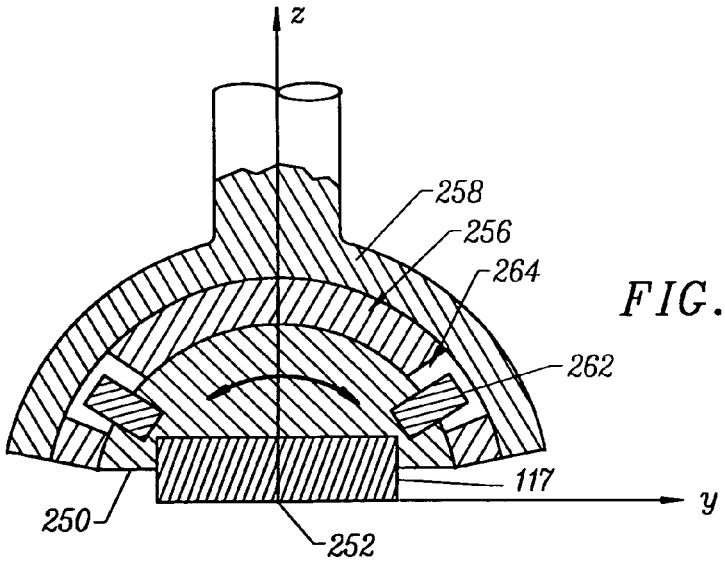
FIG. 3C is a cross-sectional view of the gimbal drive support of FIG. 3B along 1—1.
Figure 3D:
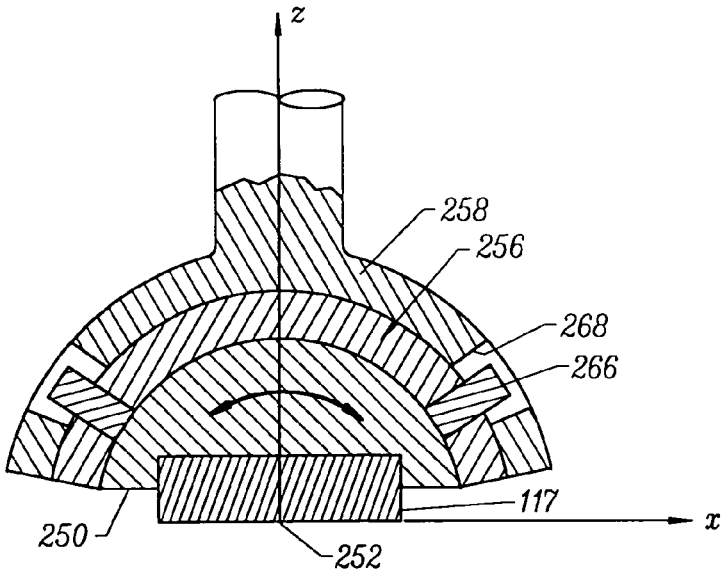
FIG. 3D is a cross-sectional view of the gimbal drive support of FIG. 3B along 2—2.
Figure 3E:
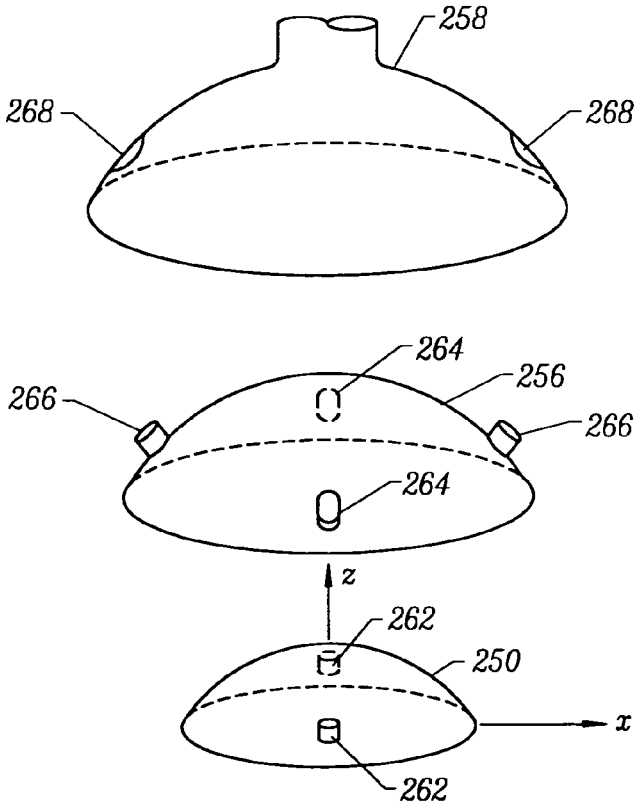
FIG. 3E is an exploded perspective view of the gimbal drive support of FIG. 3B.

In the specific embodiment as shown in FIG. 1, the dual arm 119 is a C-shaped clamp having projected gimbal points that allow for flexing of the dual arm 119 and still keep the face of the wafer in good contact with the polishing pad 117. The projected gimbal points are more clearly illustrated in FIG. 3A. The polishing pad chuck 250 is supported by the first arm 310, and the back support 118 is supported by the second arm 320. The polishing pad chuck 250 has a hemispherical surface 251 centered about a pivot point or gimbal point 252 which preferably is disposed at or near the upper surface of the wafer 115. Positioning the gimbal point 252 at or near the surface of the wafer 115 allows gimbal motion or pivoting of the chuck 250 relative to the first arm 310 without the problem of cocking. Cocking occurs when the projected gimbal point is above the wafer surface, and causes the forward end of the polishing pad 117 to dig into the wafer surface at the forward edge and lift up at the rear edge. The cocking is inherently unstable. Positioning the project gimbal point on the wafer surface avoids cocking. If the gimbal point is projected below the surface of the wafer, friction between the polishing pad 117 and the wafer surface produces a skiing effect which lifts the forward edge of the polishing pad 117 and causes the rear edge to dig into the wafer surface as the polishing pad moves relative to the wafer surface. This is more stable than cocking. The desirable maximum distance between the projected gimbal point and the wafer surface depends on the size of the polishing pad 117. For example, the distance may be less than about 0.1 inch for a polishing pad having a diameter of about 1.5 inch. The distance is desirably less than about 0.1 times, more desirably less than about 0.02 times, the diameter of the polishing pad. Likewise, the spherical surface 340 of the back support 118 desirably has a projected pivot point 254 disposed at or near the lower surface of the wafer 115.

FIGS. 3B–3E show the gimbal mechanism coupling the polishing pad chuck 250 with the first arm 310. The chuck 250 is connected to an inner cup 256 which is connected to an outer cup 258 that is supported by the first arm 310 of the dual arm 119. A torsional drive motor may be coupled with the outer cup 258 to rotate the polishing pad 117 via the gimbal mechanism around the z-axis. A pair of inner drive pins 262 extend from the chuck 250 into radial slots 264 provided in the inner cup 256 and extending generally in the direction of the y-axis. The radial slots 264 constrain the inner drive pins 262 in the circumferential direction so that the chuck 250 moves with the inner cup 256 in the circumferential direction around the z-axis. The inner drive pins 262 may move along the radial slots 264 to permit rotation of the chuck 250 relative to the inner cup 256 around the x-axis.

A pair of outer drive pins 266 extend from the inner cup 256 into radial slots 268 provided in the outer cup 258 and extending generally in the direction of the x-axis. The radial slots 268 constrain the outer drive pins 266 in the circumferential direction so that the inner cup 256 moves with the outer cup 258 in the circumferential direction around the z-axis. The outer drive pins 266 may move along the radial slots 268 to permit rotation of the inner cup 256 relative to the outer cup 258 around the y-axis.

The hemispherical drive cups 256, 258 isolate two axes of motion to allow full gimbal of the gimbal mechanism about the gimbal point or pivot point 252. The gimbal mechanism allows transmission of the torsional drive of the polishing pad 117 about the z-axis without inducing a torque moment on the polishing pad 117 at the interface with the wafer surface to produce a skiing effect. The polishing pad 117 becomes self-aligning with respect to the surface of the wafer 115 which may be offset from the x-y plane.

The gimbal mechanism shown in FIGS. 3B–3E is merely illustrative. In different embodiments, the drive pins may be replaced by machined protrusions. Balls or rollers that fit into mating, crossing grooves may be used to provide rolling contact with low friction between the movable members of the mechanism. Although the embodiment shown includes a single track in the x-direction and a single track in the y-direction, additional tracks may be provided. The members of the assembly may have other shapes different from the spherical members and still provide gimbal movements or spherical drive motions. It is understood that other ways of supporting the wafer and of tracking the polishing pad may be employed to provide the projected gimbal point at the desired location.

Planarization apparatus 100 operates as follows. Referring back to FIG. 1, assembly 110 positions wafer 115 between polishing pad 117 and back support 118. The polishing pad is lowered onto the process surface 170 of the wafer 115. Pad assembly 116 is driven by a conventional actuator (not shown), a piston-driven mechanism, for example, having variable-force control to control the downward pressure of the pad 117 upon the process surface 170. The actuator is typically equipped with a force transducer to provide a downforce measurement that can be readily converted to a pad pressure reading. Numerous pressure-sensing actuator designs, known in the relevant engineering arts, can be used.

Figure 4:
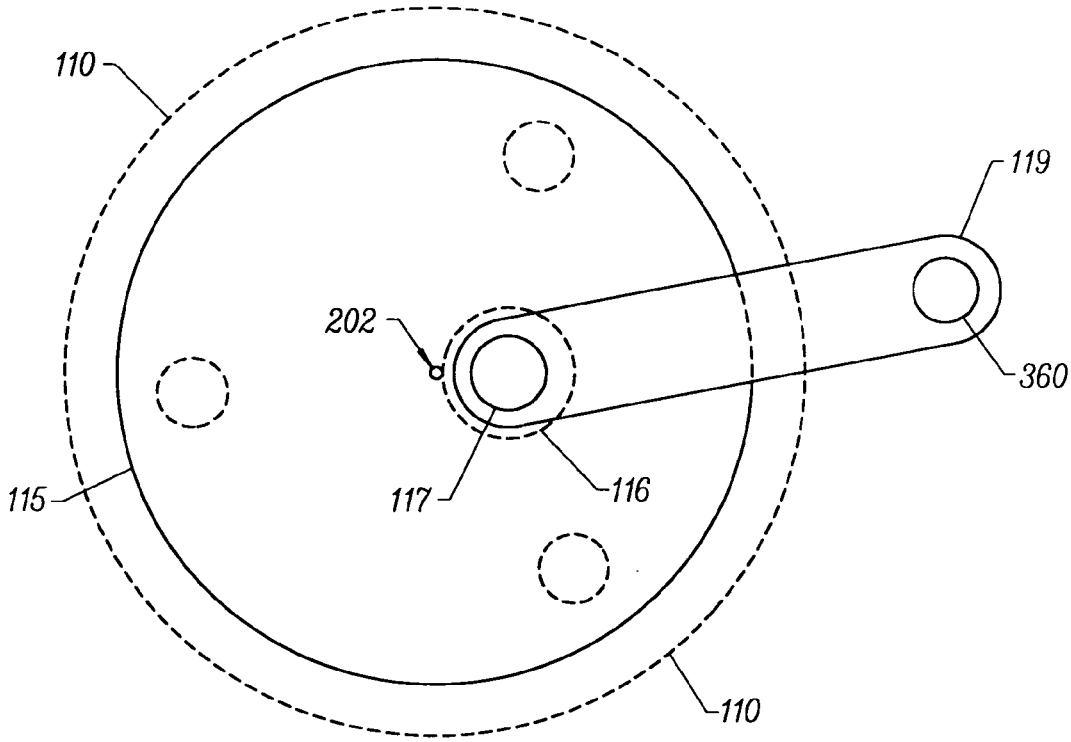
FIG. 4 is a simplified top-view diagram of a planarization apparatus according to an embodiment of the present invention.

FIG. 4 is a simplified top-view diagram of planarization apparatus 100 according to an embodiment of the present invention. This diagram is merely an example, which should not limit the scope of the claims herein. One of ordinary skill in the art would recognize many other variations, modifications, and alternatives. In a specific embodiment, dual arm 119 is configured to pivot about a pivot shaft 360 to provide translational displacement of pad assembly 116, and polishing pad 117, relative to guide and spin assembly 110, and wafer 115. Pivot shaft 360 is fixed to a planarization apparatus system (not shown).

Figure 4A:
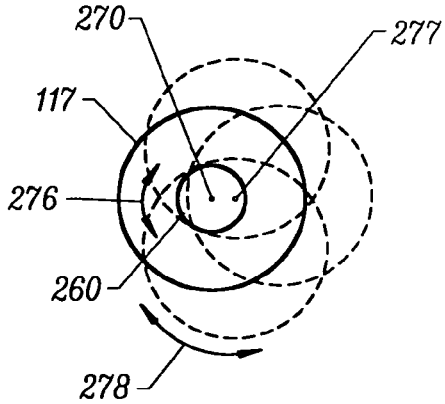
FIG. 4A is a simplified top-view diagram of the polishing pad and spindle illustrating spin and orbit rotations.

The polishing pad spindle 260 may also rotate to rotate the polishing pad 117, as illustrated in FIG. 4A. In addition to the spin rotation 276 about its own axis 270, the spindle 260 may also orbit about an orbital axis 277 in directions 278 to produce orbiting of the polishing pad 117 as shown in broken lines. The orbital axis 277 is offset from the spin axis 270 by a distance which may be selected based on the size of the wafer 115 and the size of the polishing pad 117. For instance, the offset distance may range from about 0.01 inch to several inches. In a specific example, the distance is about 0.25 inch. The orbital rotation is more clearly illustrated in FIG. 4A. Different motors may be used to drive the spindle 260 in spin and to drive the spindle 260 in orbital rotation.

Figure 4B:
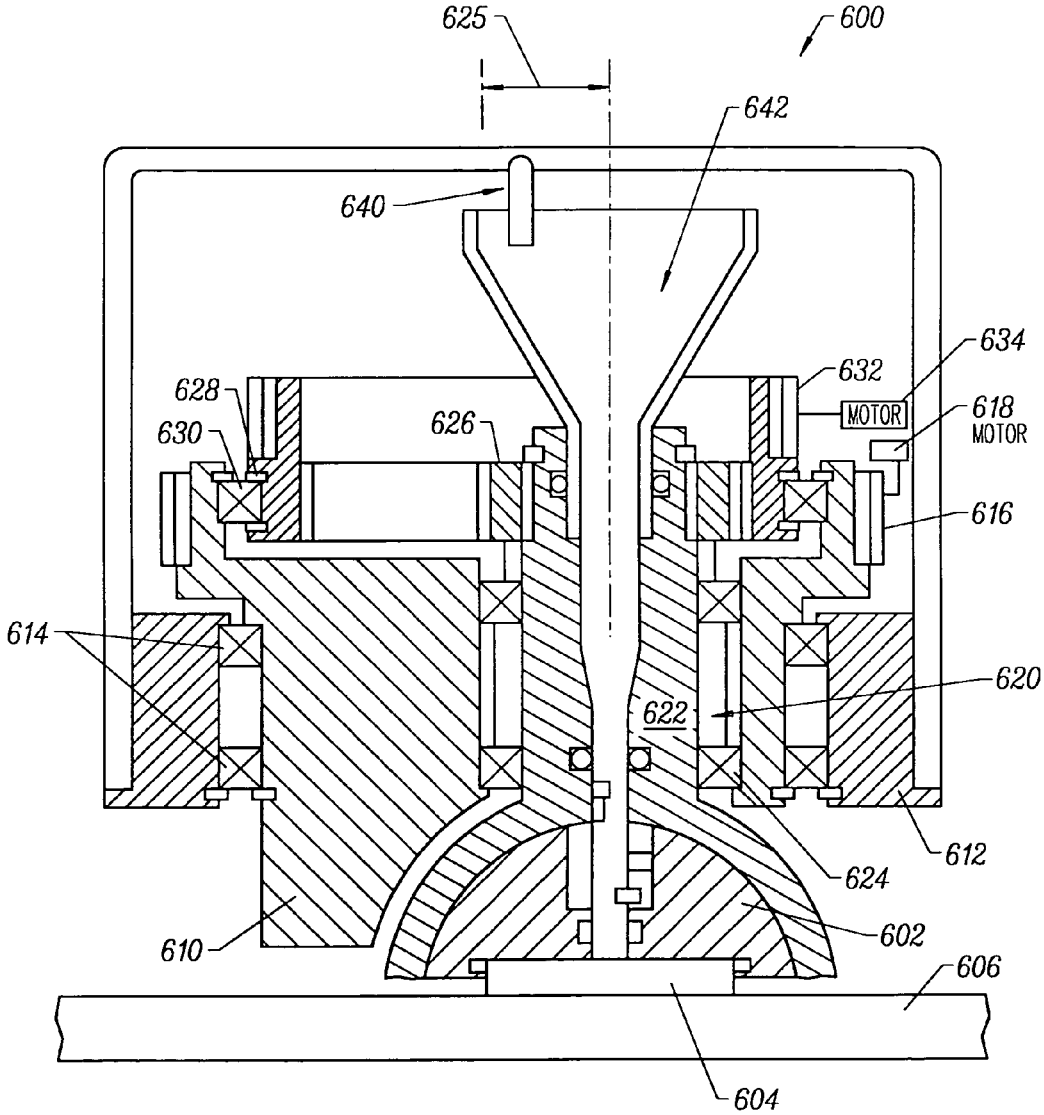
FIG. 4B is a sectional view diagram of the orbit and spin mechanism for the polishing head in accordance with an embodiment of the present invention.

FIG. 4B shows an apparatus 600 that allows both orbital and pure spin motion of a polishing head 602 that holds a polishing pad 604 which is smaller in size than the wafer 606 for planarizing the wafer. An orbit housing 610 is held in place with respect to the arm frame 612 by bearings 614 and driven directly by a direct orbit motor or through an orbit belt or an orbit gear. FIG. 4B shows an orbit drive belt 616 coupled to an orbit motor 618. The orbit housing 610 has an eccentric or offset hole 620 which supports a shaft 622 with bearings 624. The shaft 622 is offset from the centerline of the orbit housing 610 by an offset 625 which may be set to any desired amount (e.g., about 0.5 inch). The shaft 622 is connected to the polishing head 602. An external tooth gear 626 (or friction drive or the like) is attached to the shaft 622 and mates with an internal tooth gear 628 (or friction drive). The internal tooth gear is a ring gear 628 supported by another bearing 630 concentric with the outer orbit housing bearings 614, and is driven by a direct spin motor, or through a spin gear or a shaft drive belt. FIG. 4B shows a spin drive belt 632 coupled to a spin motor 634. By controlling the relative speeds of the orbit motor 618 and the spin motor 634, the polishing head 602 can be made to spin only (while holding the orbit motor 634 stationary), to spin and orbit (i.e., to precess), or to orbit only (by controlling the relative motions of the two motors 618, 634 so that the polishing pad 604 does not spin relative to the wafer 606). FIG. 4B also shows a chemical/fluid/slurry supply 640 supplying the chemical/fluid/slurry through a feed passage 642 to the polishing pad 604.

The inventors have discovered that improved uniformity of planarization can be achieved by polishing the center of the wafer by predominately orbital motion and polishing the edge of the wafer by predominately spin motion. Predominate orbital motion at the center of the wafer produces relatively uniform surface velocity motion to the entire polish pad surface where the center of the wafer is at a theoretical zero velocity. This results in good uniformity at the center of the wafer while maintaining superior planarity. Pure spin motion allows a very precise balance position at the edge of the wafer to give superior edge exclusion polish results where the orbital motion causes the pad to tend to drop off the edge too far before the center of action can be close enough to the edge to achieve good removal. This produces good uniformity results at the edge of the wafer while maintaining superior planarity results. In some embodiments, the orbiting speed is greater than the spinning speed when the polishing pad is contacted with the center region of the wafer. In a specific embodiment, the spinning speed is approximately zero at the center region. In some embodiments, the spinning speed is greater than the orbiting speed when the polishing pad is contacted with an edge region of the wafer. In a specific embodiment, the orbiting speed is approximately zero at the edge region.

The inventors have also found that uniformity can be affected by the relative wafer rotational speed and orbiting speed of the polishing pad. For instance, during combined orbital motion and rotation of the wafer, if the ratio of the greater of the orbiting speed and the wafer rotational speed to the lesser of the two is an integer, then the polishing pattern will repeat in a Rosette pattern and produces nonuniformity polishing. Typically, the orbiting speed is larger than the wafer rotational speed. Thus, it is desirable to have the ratio of the two speeds be a non-integer to achieve improved uniformity during planarization. For example, if the orbiting speed is 1000 rpm, the wafer rotational speed may be 63 rpm.

Figure 5:
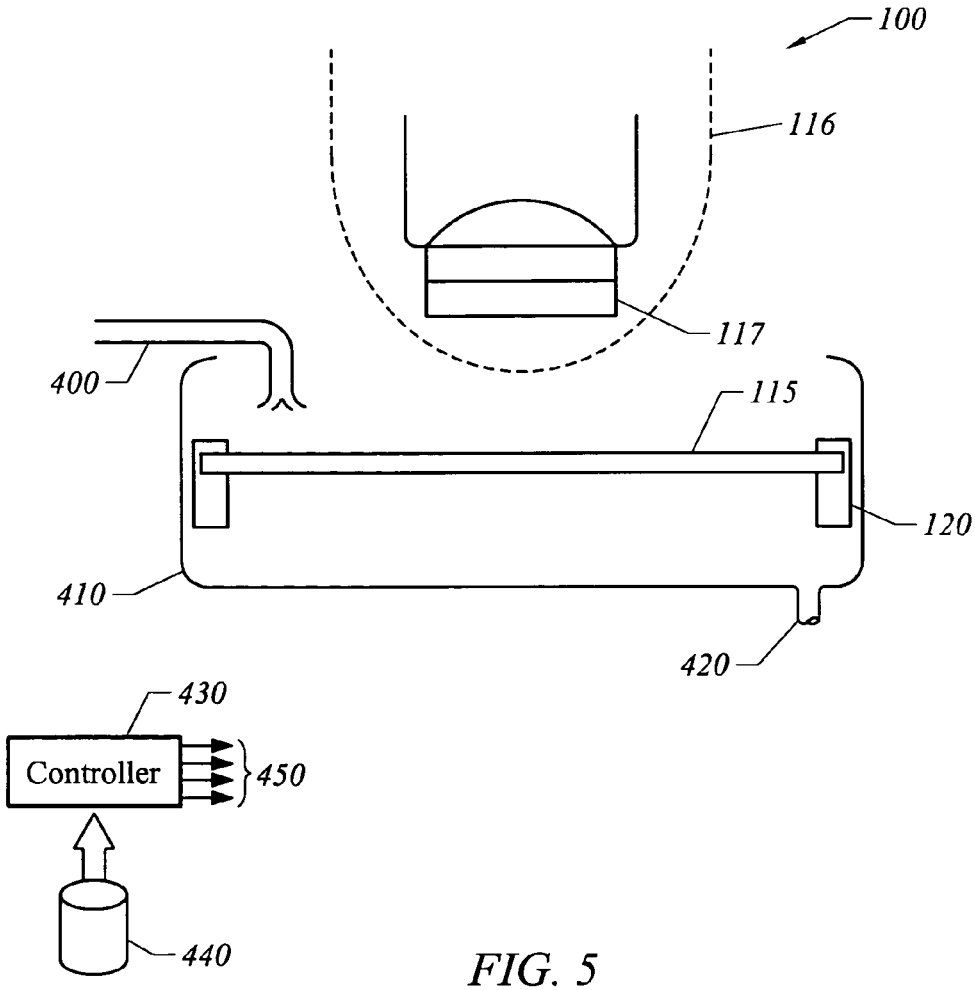
FIG. 5 is an alternative diagram of a planarization apparatus according to another embodiment of the present invention.

FIG. 5 is an alternative diagram of planarization apparatus 100 according to another embodiment of the present invention. This diagram is merely an example, which should not limit the scope of the claims herein. One of ordinary skill in the art would recognize many other variations, modifications, and alternatives. In a specific embodiment, a slurry delivery mechanism 400 is provided to dispense a polishing slurry (not shown) onto the process surface of wafer 115 during planarization. Although FIG. 5 shows a single mechanism 400 or dispenser 400, additional dispensers may be provided depending on the polishing requirements of the wafer. Polishing slurries are known in the art. For example, typical slurries include a mixture of colloidal silica or dispersed alumina in an alkaline solution such as KOH, $NH_4OH$ or $CeO_2$. Alternatively, slurry-less pad systems can be used.

A splash shield 410 is provided to catch the polishing fluids and to protect the surrounding equipment from the caustic properties of any slurry that might be used during planarization. The shield material can be polypropylene or stainless steel, or some other stable compound that is resistant to the corrosive nature of polishing fluids. The slurry can be dispose via a drain 420.

A controller 430 in communication with a data store 440 issues various control signals 450 to the foregoing-described components of the planarization apparatus. The controller provides the sequencing control and manipulation signals to the mechanics to effectuate a planarization operation. The data store 440 can be externally accessible. This permits user-supplied data to be loaded into the data store 440 to provide the planarization apparatus with the parameters for planarization. This aspect of the invention will be further discussed below.

Any of a variety of controller configurations is contemplated for the present invention. The particular configuration will depend on considerations such as throughput requirements, available footprint for the apparatus, system features other than those specific to the invention, implementation costs, and the like. In a specific embodiment, controller 430 is a personal computer loaded with control software. The personal computer includes various interface circuits to each component of apparatus 100. The control software communicates with these components via the interface circuits to control apparatus 100 during planarization. In this embodiment, data store 440 can be an internal hard drive containing desired planarization parameters. User-supplied parameters can be keyed in manually via a keyboard (not shown). Alternatively, the data store 440 is a floppy drive in which case the parameters can be determined elsewhere, stored on a floppy disk, and carried over to the personal computer. In yet another alternative, the data store 440 is a remote disk server accessed over a local area network. In still yet another alternative, the data store 440 is a remote computer accessed over the Internet; for example, by way of the world wide web, via an FTP (file transfer protocol) site, and so on.

In another embodiment, controller 430 includes one or more microcontrollers that cooperate to perform a planarization sequence in accordance with the invention. Data store 440 serves as a source of externally provided data to the microcontrollers so they can perform the polish in accordance with user-supplied planarization parameters. It should be apparent that numerous configurations for providing user-supplied planarization parameters are possible. Similarly, it should be clear that numerous approaches for controlling the constituent components of the planarization apparatus are possible.

Planarization Calibration System

Figure 6:
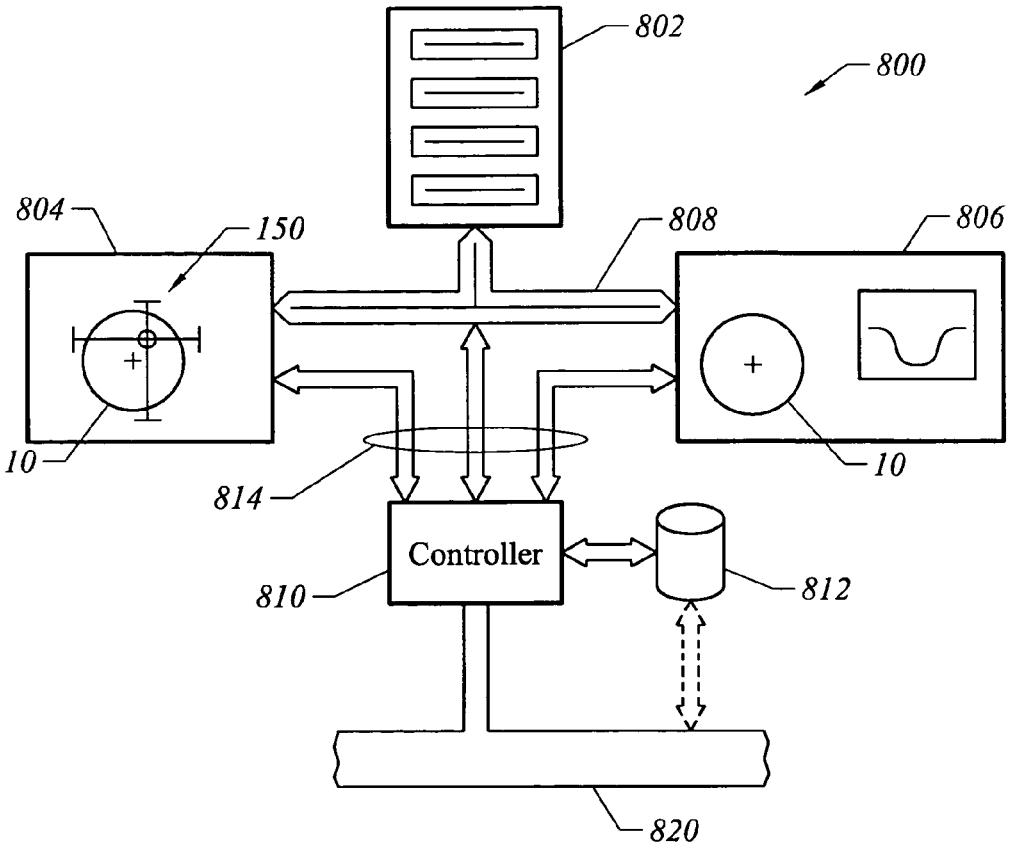
FIG. 6 is a simplified block diagram of a planarization calibration system according to an embodiment of the present invention.

FIG. 6 is a simplified block diagram of a planarization calibration system of the present invention. It is noted that the figure is merely a simplified block diagram representation highlighting the components of the planarization apparatus of the present invention. The system shown is exemplary and should not unduly limit the scope of the claims herein. A person of ordinary skill in the relevant arts will recognize many variations, alternatives and modifications without departing from the scope and spirit of the invention. Planarization system 800 includes a planarization station 804 for performing planarization operations. Planarization station 804 can use a network interface card (not shown) to interface with other system components, such as a wafer supply, measurement station, transport device, etc. There is a wafer supply 802 for providing blank test wafers and for providing production wafers. A measurement station 806 is provided for making surface measurements from which the removal profiles are generated. The planarization station 804, wafer supply 802 and measurement station 806 are operatively coupled together by a robotic transport device 808. A controller 810 includes control lines and data input lines 814 that cooperatively couple together the constituent components of system 800. Controller 810 includes a data store 812 for storing at least certain user-supplied planarization parameters. Alternatively, data store 812 can be a remotely accessed data server available over a network in a local area network.

Controller 810 can be a self-contained controller having a user interface to allow a technician to interact with and control the components of system 800. For example, controller 810 can be a PC-type computer having contained therein one or more software modules for communicating with and controlling the elements of system 800. Data store 812 can be a hard drive coupled over a communication path 820, such as a data bus, for data exchange with controller 810.

In another configuration, a central controller (not shown) accesses controller 810 over communication path 820. Such a configuration might be found in a fabrication facility where a centralized controller is responsible for a variety of such controllers. Communication path 820 might be the physical layer of a local area network. As can be seen, any of a number of controller configurations is contemplated in practicing the invention. The specific embodiment will depend on considerations such as the needs of the end-user, system requirements, system costs, and the like.

The system diagrammed in FIG. 6 can be operated in production mode or in calibration mode. During a production run, wafer supply 802 contains production wafers. During a calibration run, wafer supply 802 is loaded with test wafers. Measurement station 806 is used primarily during a calibration run to perform measurements on polished test wafers to produce removal profiles. However, measurement station 806 can also be used to monitor the quality of the polish operation during production runs to monitor process changes over time.

In another embodiment, measurement system 806 can be integrated into planarization station 804. This arrangement provides in situ measurement of the planarization process. As the planarization progresses, measurements can be taken.

These real time measurements allow for fine-tuning of the planarization parameters to provide higher degrees of uniform removal of the film material.

The program code constituting the control software can be expressed in any of a number of ways. The C programming language is a commonly used language because many compilers exist for translating the high-level instructions of a C program to the corresponding machine language of the specific hardware being used. For example, some of the software may reside in a PC based processor. Other software may be resident in the underlying controlling hardware of the individual stations, e.g., planarization station 804 and measurement station 806. In such cases, the C programs would be compiled down to the machine language of the microcontrollers used in those stations. In one specific embodiment, the system employs a PC-based local or distributed control scheme with soft logic programming control.

As an alternative to the C programming language, object-oriented programming languages can be used. For example, C++ is a common object-oriented programming language. The selection of a specific programming language can be made without departing from the scope and spirit of the present invention. Rather, the selection of a particular programming language is typically dependent on the availability of a compiler for the target hardware, the availability of related software development tools, and on the preferences of the software development team.

In-Situ Feature Height Measurement

In one preferred embodiment, the local endpoints of the wafer are measured in situ during planarization using an optical device to determine whether the target planarization has been reached and to ascertain completeness of planarization. Reflected light intensity is measured from the surface of a wafer with a light source and sensor source return signal to identify any differences in the reflected light signal intensity from the edges of the features. The field of view and magnification will determine how many features are averaged into the same reading. The optical measurement is used to determine local endpoint or polish progress during planarization. The planarization process desirably employs a real-time feature monitoring and real-time feedback and dynamic control to adjust the planarization process in response to the measurements. This system may, for instance, control movement of the polishing pad to very the path and dwell time, vary the force applied by the polishing pad on the wafer, and adjust the relative velocities of the pad and the wafer, such as the rotational speed of the wafer, or the spinning and/or orbiting speed of the polishing pad. Other variables may also be controlled and synchronized in response to the measurements.

Figure 7:
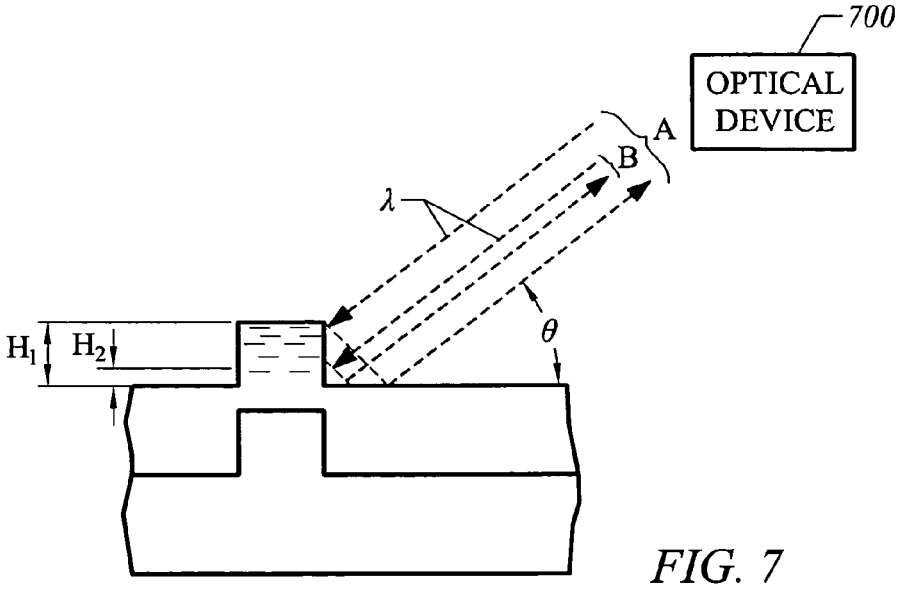
FIG. 7 is a simplified diagram of a feature height measurement device according to an embodiment of the present invention.

FIG. 7 shows a schematic of the optical measurement of feature heights of surface features on the wafer surface using an optical device 700. The spacing (A) of the reflected light from the incident light is greater with a greater feature height $H_1$ than the spacing (B) of the reflected light from the incident light with a smaller feature height $H_2$. The feature height measured is a relative step height. The optical device 700 provides the incident light (e.g., using a light emitting diode) and detects the reflected light (e.g., using a light detecting diode). The light emitting member and the light detecting member are typically disposed in the same general vicinity of, and may be in close proximity with, one another. The angle $\theta$ and wavelength $\lambda$ may be optimized depending on the target process wafer. It is further desirable to evaluate the surface conditions (e.g., water, chemicals, polish materials, polish residue) and determine the best way to normalize the effects on the optical measurement. Alternative embodiments of the invention may employ other optical measuring schemes that may be based on color changes, wavelength variations, vibration, or other optical features using optical sensors or other sensors instead of light reflectance and intensity changes.

FIG. 7 illustrates the use of retroreflection to detect the presence of features on the surface and measure the feature heights. A local horizontal surface and a local vertical surface in combination supply the retroreflected light to be sensed. The relative intensity/pattern of the retroreflected light is measured. No polarization is used. As the feature height becomes smaller, the amount of the retroreflected light is reduced. When there is no feature height, none of the light is retroreflected.

Figure 8:
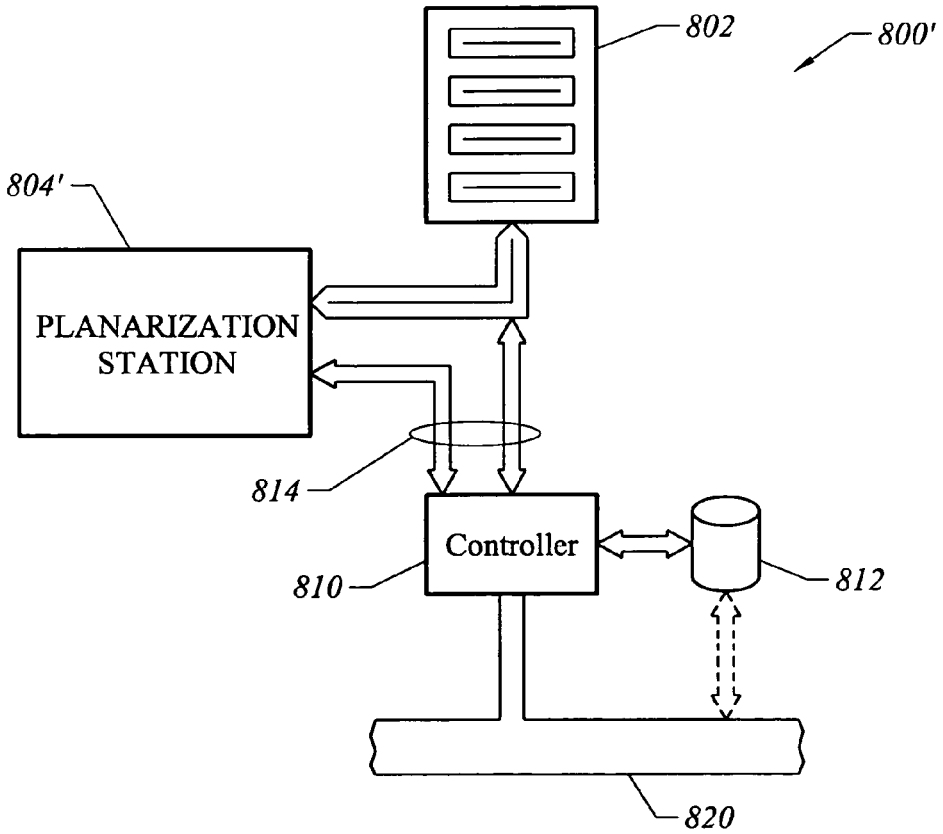
FIG. 8 is a simplified block diagram of a planarization calibration system according to another embodiment of the present invention.

FIG. 8 shows a simplified block diagram of the planarization calibration system 800' similar to that of FIG. 6, but with the measurement system integrated into planarization station 804' to provide in situ measurement of the planarization process. As the planarization progresses, measurements can be taken. These real time measurements allow for fine-tuning of the planarization parameters to provide higher degrees of uniform removal of the film material.

In-Situ Feature Height Measurement Device Embedded in Polishing Pad

Figure 9:
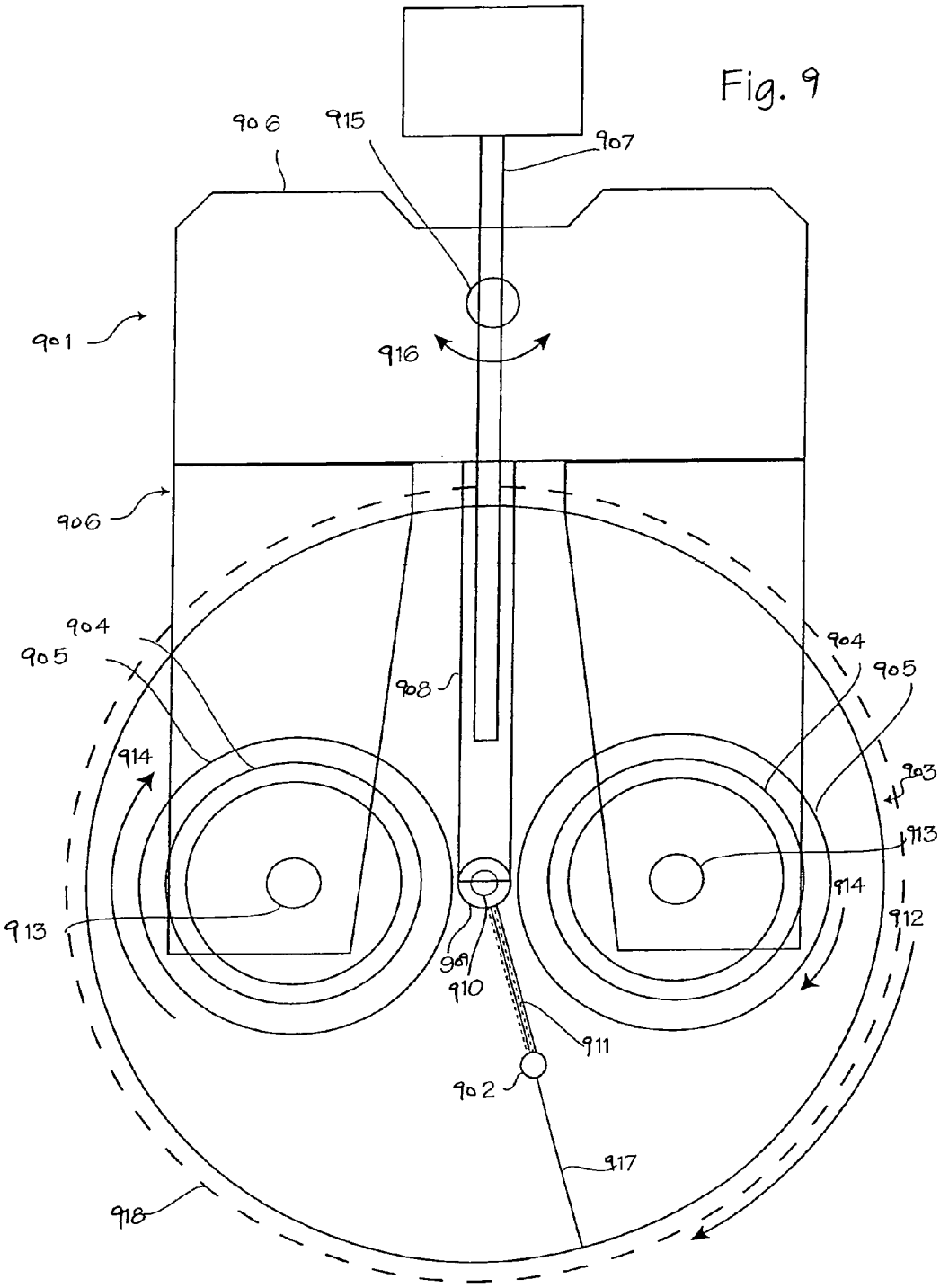
FIG. 9 is a top plan view schematically illustrating a full-aperture planarization apparatus having an optical sensor port according to another embodiment of the present invention.

FIG. 9 is a top plan view of a chemical mechanical system 901 with the optical port 902 cut into the polishing pad 903. The wafer 904 (or other workpiece requiring planarization or polishing) is held by the polishing head 905 and suspended over the polishing pad 903 from a translation arm 906. Other systems may use several polishing heads that hold several wafers, and separate translation arms on opposite sides (left and right) of the polishing pad.

The slurry used in the polishing process is injected onto the surface of the polishing pad through slurry injection tube 907. The suspension arm 908 connects to the nonrotating hub 909 that suspends over the electronics assembly hub 910. The electronics assembly hub 910 is removably attached to the polishing pad 903 by means of twist lock, detents, snap rings, screws, threaded segments, or any releasable mating mechanism. The hub 910 is attached to an electrical conducting assembly located within the pad 903 where the hub attaches. The electrical conducting assembly can be either a single contact or a plurality of contacts attached to a thin, electrically conducting ribbon 911, also known as a flex circuit or ribbon cable. The ribbon 911 electrically connects an optical sensor mechanism, located within the optical port 902 and embedded in the pad 903, to the electronics in the electronics hub 910. The ribbon 911 may also comprise individual wires or a thin cable.

The window rotates with the polishing pad, which itself rotates on a process drive table, or platen 918, in the direction of arrow 912. The polishing heads rotate about their respective spindles 913 in the direction of arrows 914. The polishing heads themselves are translated back and forth over the surface of the polishing pad by the translating spindle 915, as indicated by arrow 916. Thus, the optical port 902 passes under the polishing heads while the polishing heads are both rotating and translating, swiping a complex path across the wafer surface on each rotation of the polishing pad/platen assembly.

The optical window 902 and the electrical conducting assembly always remain on the same radial line 917 as the pad 903 rotates. However, the radial line translates in a circular path as pad 903 rotates about the hub 909. The conducting ribbon 911 lies along the radial line 917 and moves with it.

Figure 10:
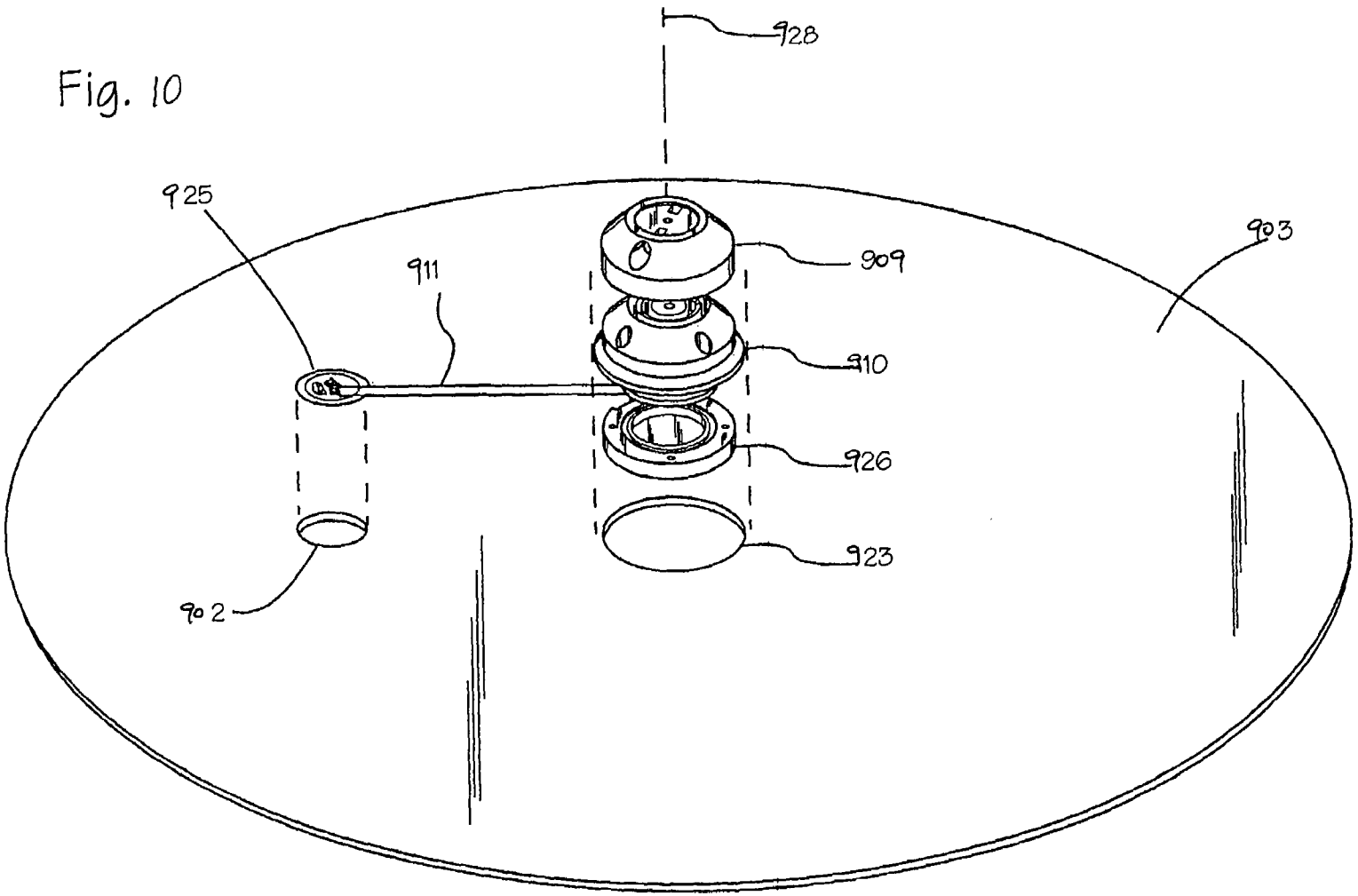
FIG. 10 is a perspective view of an optical assembly in the apparatus of FIG. 9.

As shown in FIG. 10, the polishing pad 903 has a circular shape and a central circular aperture 923. A hole or cavity 902 is formed in the polishing pad, and the hole opens upwardly so as to face the surface that is being polished. An optical sensor 925 is placed in the hole 902 and a conductor ribbon 911, which extends from the optical sensor 925 to the central aperture 923, is embedded within the polishing pad 903. The hole 902 may also be a window or port that extends through the entire pad or the hole may be a blind hole. Various sensors may be used in place of optical sensors, including electrical sensors, heat sensors, impedance sensors, acoustic sensors, and other sensors.

When the polishing pad 903 is to be used, an electronics hub is inserted from above into the central aperture 923 and secured there by screwing a base 926, which lies below the polishing pad 903, onto a threaded portion of the hub 910. The polishing pad 903 is thus clamped between portions of the hub and portions of the base 926. During the polishing process, the polishing pad 903, the hub 910 and the base 926 rotate together about a central vertical axis 928. The polishing pad may also be provided with a snap ring such that the hub may secured to the polishing pad by snapping the hub into the snap ring.

The nonrotating hub 909 of the polishing machine is located adjacent and above the hub 910. The nonrotating hub 909 is fixed during operation to the suspension arm 908.

Figure 11:
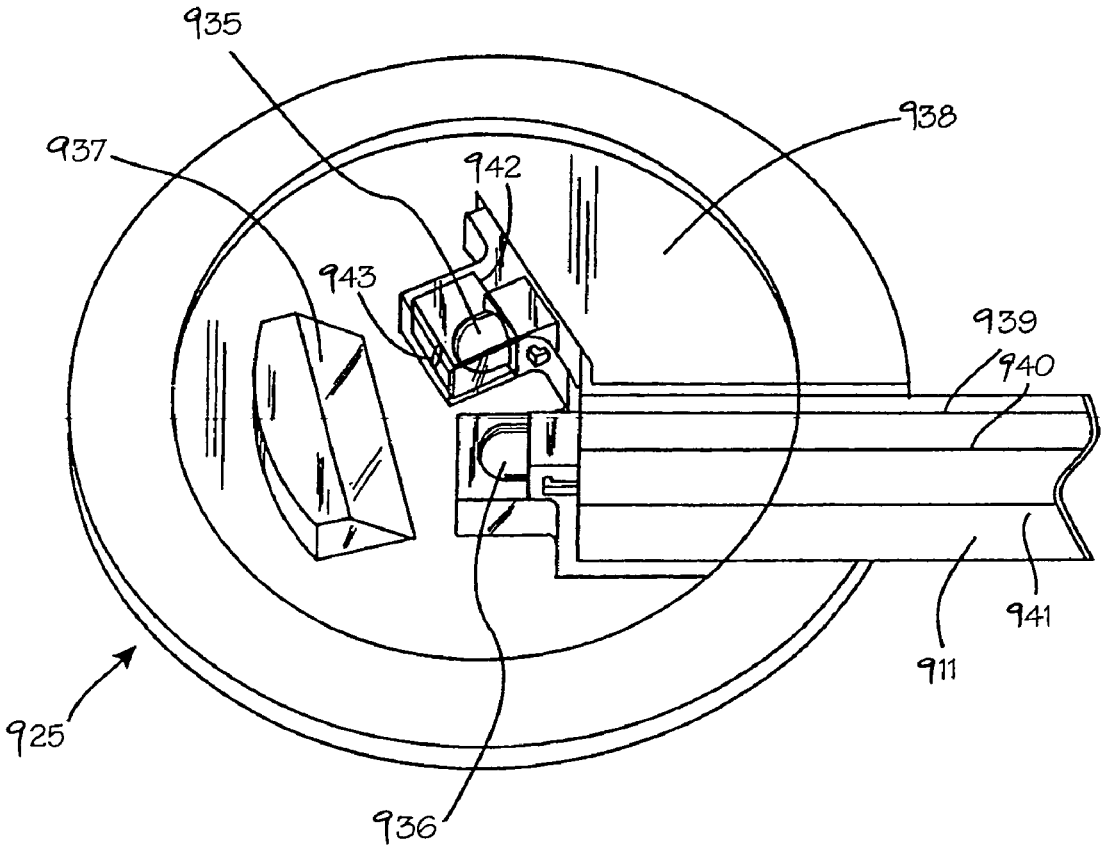
FIG. 11 is a perspective view of the optical sensor in the apparatus of FIG. 9.

FIG. 11 shows the optical sensor 925 in greater detail. The optical sensor 925 includes a light source 935, a detector 936, a reflective surface 937 (which could be a prism, mirror, boundary of a void disposed in the sensor material, or other reflective optical component), and the conductor ribbon 911. The conductor ribbon 911 includes a number of generally parallel conductors laminated together for the purpose of supplying electrical power to the light source 935 and for conducting the electrical output signal of the detector 936 to the central aperture 923. Preferably, the light source 935 and the detector 936 are a matched pair. In general, the light source 935 is a light emitting diode and the detector 936 is a photodiode. The central axis of the beam of light emitted by the light source 935 is directed horizontally initially, but upon reaching the reflective surface 937 the light is redirected upward so as to strike and reflect from the surface that is being polished. The reflected light also is redirected by the reflective surface 937 so that the reflected light falls on the detector 936, which produces an electrical signal in relation to the intensity of the light falling on it. The arrangement shown in FIG. 11 was chosen to minimize the height of the sensor.

The optical components and the end of the conductor ribbon 911 are encapsulated in the form of a thin disk or capsule 938 that is sized to fit snugly within the hole 902 of FIG. 10. Included within the conductor ribbon 911 are three conductors: a power conductor 939, a signal conductor 940, and one or more return or ground conductors 941. In the arrangement of FIG. 11 baffles 942, each having a baffle aperture 943, may be used to reduce the amount of nonreflective light reaching the detector 936. The baffles 942 may be added to the light source as well as to the light detector.

Figure 12:
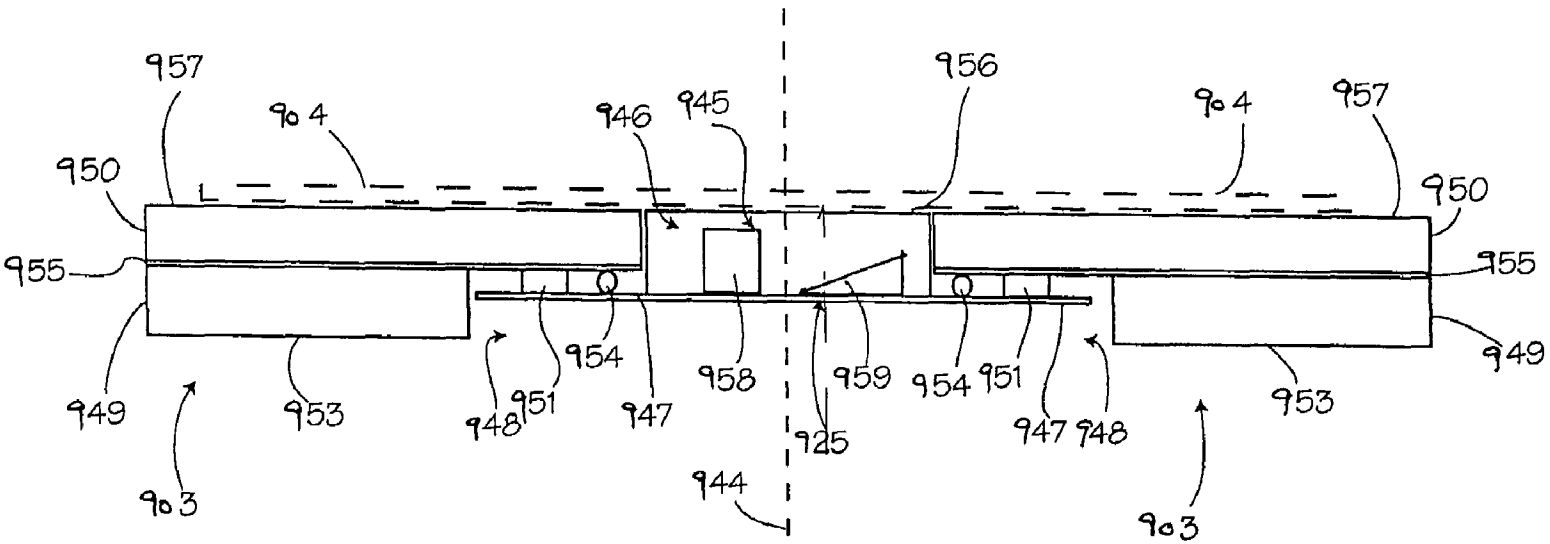
FIG. 12 is a sectional view of the apparatus of FIG. 9 schematically showing an arrangement of the optical assembly according to one embodiment of the invention.

FIG. 12 shows an optical assembly 925 disposed within a polishing pad 903 such that the optical assembly may move up and down (along axis 944) within the polishing pad. The optical assembly 925 comprises an optical sensor 945 and a sensor housing, capsule, or puck 946 in which the sensor is disposed. The optical sensor may instead comprise any technique for monitoring the progress of polishing (or a technique for detecting characteristics of the wafer or other work piece during polishing), such as heat sensor, pH sensors, ultrasound sensors, radio frequency sensors, resistance sensors, or electric field or current sensors. The sensor housing or capsule comprises a thermoplastic resin or other resilient, transparent material having a top surface, a bottom surface, and a thickness.

The optical assembly 925 is provided with an extension (which may be annular) or a flange 947 sized and proportioned to be disposed within a hole 948 cut into the lower layer 949 of polishing pad 903 (the hole in the lower layer 949 of the pad is larger than the hole in the upper layer 950). The flange 947 is connected to the upper pad layer 950 with a bead of glue 951, or is connected by any other suitable mechanisms. Thus, the optical assembly 925 is suspended from the upper layer 950 of the pad 903. The top side of the optical assembly may be provided with a beveled edge to further prevent wear on the wafer 904 (shown in phantom) and to provide a smooth surface for wafer override. The optical assembly 925 and the flange 947 are thin enough to leave a space between the bottom of the optical assembly and the bottom surface 953 of the bottom layer 949 of the pad 903.

The flange 947 may be disposed on the optical assembly 925 by a variety of methods. For example, the flange may be molded integrally with the optical assembly 925. In addition, a thin, flexible cylinder or membrane may be disposed on the bottom of the optical assembly or one or more extensions may be attached to the side of the optical assembly. The flange may extend partially around the perimeter of the optical assembly or may extend around the entire perimeter of the optical assembly.

In general, the sensor housing may be conceived of as a capsule having an upper capsule section and a lower capsule section: The lower capsule section is typically larger than the upper capsule section so that the lower capsule section may be suspended from an overhanging lip of an upper hole section in the polishing pad. However, the lower capsule section may be the same size or smaller than the upper capsule section in another embodiment where a small pad or spring is used to keep the capsule co planar with the top surface of the polishing pad, or where other mechanisms of biasing the capsule or connecting it to the pad are used.

A shim or spacer 954 may be disposed between the glue bead 951 and the upper part of the optical assembly (which may be an upper cylinder) and further disposed between the flange and the upper pad layer. The shim 954 prevents glue from entering the space between the upper part of the optical assembly and the shim. Thus, the optical assembly 925 can more easily move up and down within the polishing pad 903 and the regions of the pad closest to the upper part of the optical assembly can deform or deflect independently of the upper part of the optical assembly.

The pad 903 may comprise any polishing pad used in chemical mechanical planarization, grinding, or polishing. The pad may also comprise a pad with multiple layers or a single layered pad. For example, the pad may comprise a Rodel IC 1000 pad having a lower layer 949, an upper layer 950, and an adhesive layer 955. The upper layer 950 may comprise urethane and the lower layer may comprises a different form of urethane having a different hardness. The upper layer 950 and the lower layer 949 are connected by the adhesive layer 955. In the IC 1000, the upper layer has a hardness of about 50 to 55 Shore D. The optical assembly housing used with this pad comprises a transparent and resilient material (such as a thermoplastic material like Pellethane 2101™ by Dow Chemical) having a hardness of about 90 Shore A (approximately 45 Shore D). Thus, the optical assembly is slightly softer than the upper pad.

Regardless of the number of layers, a hole is disposed in the pad 903 extending from the top surface 957 to the bottom surface 953 to accommodate the optical assembly. The hole may comprise an upper hole section and a lower hole section. The lower hole section may be larger than the upper hole section in order to accommodate the flange (or lower capsule section) within the lower hole section. The upper part of the optical assembly (or the upper capsule section) is disposed within the upper hole section. The lower section of the optical assembly (or the lower capsule) is suspended from an overhanging lip. The upper hole section defines the overhanging lip over the lower hole section.

In another embodiment, the optical assembly 925 may be disposed within the optical port 902 and a small resilient pad or a spring may be disposed on the bottom of the optical assembly. In either case the resilient pad or spring may be attached to the polishing pad, may be attached to the optical assembly with a glue or adhesive, or may be attached to both the polishing pad and attached to the optical assembly. Typically the bottom of the resilient pad or spring will be flush with the bottom surface of the polishing pad. The resilient pad may comprise a pad of urethane or other material of sufficient resiliency to allow the optical assembly to move up and down (along axis 944). The spring may comprise any spring that has a spring constant that allows the optical assembly to move up and down. In either case the resilient pad or spring may be used with or without the flange, glue, shims, or spacers. In addition, the resilient pad or spring may be used with only a single hole in the polishing pad, as opposed to disposing a larger hole in the lower pad.

In use the polishing pad 903 polishes a wafer 904 and the optical assembly 925 monitors the progress of planarization. However, since the optical assembly 925 may move up and down with the upper pad 950, the top 956 of the optical assembly 925 will remain flush (co planar) with the upper surface 957 of the pad even if the pad material is worn away faster than the optical assembly material or if a wafer carrier moves across the pad and deforms and compress the pad as it moves. Thus, the wafer will be ground evenly across its entire surface regardless of the relative wear rates of the optical assembly and the polishing pad.

Figure 12A:
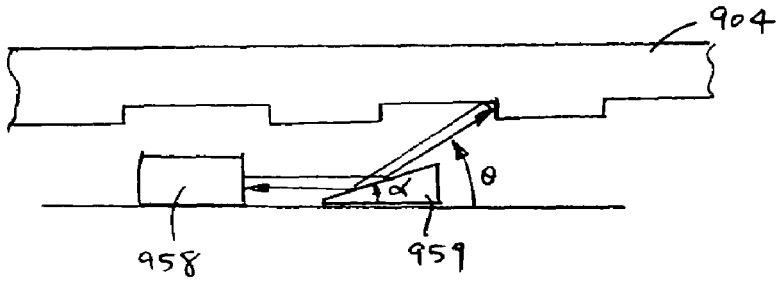
FIG. 12A is a schematic view of an arrangement of the optical assembly of FIG. 12.

FIG. 12 also shows the features of an optical sensor 945 capable of performing optical measurements on a wafer disposed above the optical assembly. The optical sensor 945 may comprise a variety of optical light sources (such as diodes, lasers, lamps, and other sources of light) and detectors (such as photodiodes, cameras, charged couple devices, or other devices for detecting light). In one embodiment a light emitting diode 958 emits light towards a mirror 959. The mirror may comprise a discrete mirror. The mirror 959 has an orientation that directs the light toward the wafer surface of the wafer 904 at an angle other than 90° so as to measure the feature height using the retroreflection technique described above in connection with FIG. 7. As best seen in FIG. 12A, the mirror 959 has a shallow angle $\alpha$ of about 15°–22.5° to produce an incident angle $\theta$ of the incident light of about 30°–45°. Other angles $\theta$ and wavelength $\lambda$ may be used and optimized depending on the target process wafer.

However, the optical assembly may be molded to leave a void within the optical assembly. The boundary between the void and the optical assembly is naturally reflective, thus providing a suitable mirror for use with the light emitting diode without providing a discrete mirror within the void. In either case, the light is reflected towards the wafer. The light reflects off of the wafer surface and the reflected light is detected by a second diode (detector diode) disposed next to the light emitting diode 958. Polishing stops when the characteristics of the reflected light reach the desired values, indicating the endpoint of polishing.

Figure 12B:
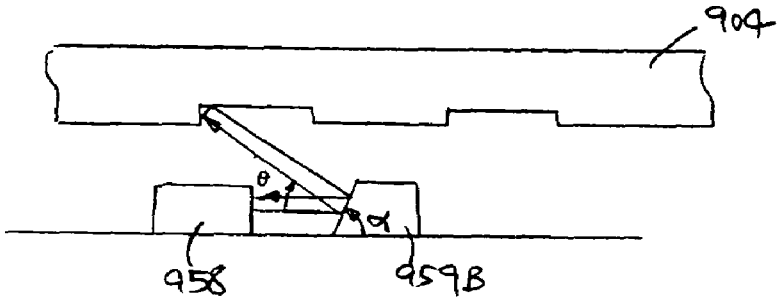
FIG. 12B is a schematic view of an arrangement of the optical assembly according to another embodiment of the invention.
Figure 12C:
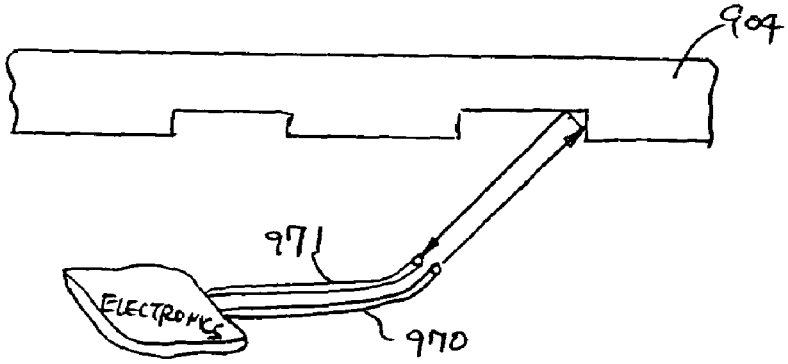
FIG. 12C is a schematic view of an arrangement of the optical assembly according to another embodiment of the invention.

FIGS. 12B and 12C show alternate embodiments of the optical elements to emit the incident light and detect the reflected light. In FIG. 12B, the mirror 959B is oriented at a steep angle of about 62.5°–75° to produce an incident angle $\theta$ of the incident light of about 30°–45° measured from the opposite side. Other angles $\theta$ and wavelength $\lambda$ may be used and optimized depending on the target process wafer. The mirror may be replaced by other reflective surfaces or other optical elements such as a prism. In FIG. 12C, a curved fiber-optic cable 970 is used to direct the incident light toward the wafer surface at an angle and a curved fiber-optic cable 971 is used to detect the retroreflected light from the wafer surface. In this case, the electronics can be located locally in a small button in the polishing pad 903 near the point of measurement, or in the central hub 910 at the center of rotation of the platen 918 and polishing pad 903.

Figure 13:
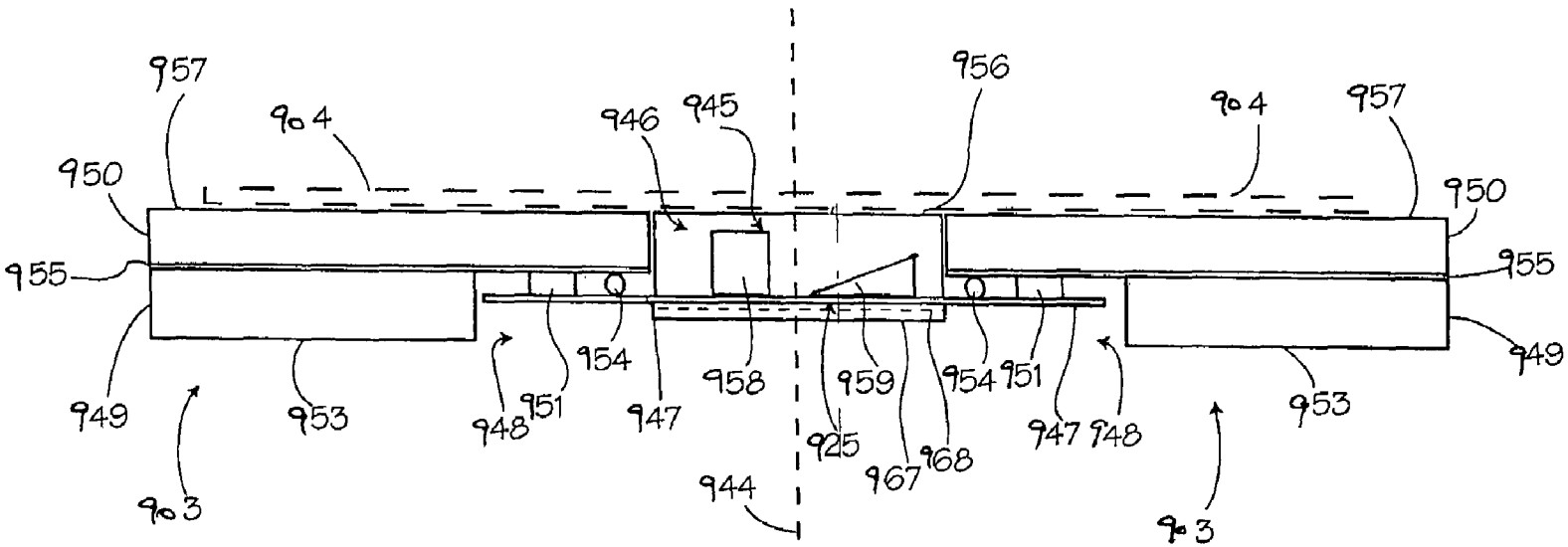
FIG. 13 is a sectional view of the apparatus of FIG. 12 with a damping pad according to another embodiment of the invention.

FIG. 13 shows the polishing pad and optical assembly of FIG. 12 and a damping pad 967 disposed on the bottom of the assembly 925 (that is, on the surface opposite the sensing surface 956). Substantially the entire bottom surface of the optical assembly is covered by the damping pad; however, the damping pad may extend to the full width of the flange or may cover less than the entire bottom surface of the optical assembly. The damping pad 967 is a soft, resilient material sized and dimensioned to fit underneath the puck 946 (or optical assembly 925). The presence of the damping pad reduces vibrations of the optical assembly during polishing, thus making optical measurements of the wafer 904 more sensitive than in the case where the optical sensor is not provided with a damping pad.

The damping pad 967 may comprise any material suitable for use in a CMP pad that has a hardness of about 30 Shore A to about 50 Shore A, preferably about 40 Shore A. Suitable materials include latex, rubber, or other elastomeric materials. Generally, the pad 967 may comprise materials having differing hardness, density, or acoustic impedance as compared to the optical assembly or puck. (Harder materials may be used by perforating the pad in a number of locations, thereby causing the harder material to behave like a softer material when subject to vibrations). The damping pad 967 is typically about 9 mil to about 20 mil thick, along axis 944, with a thickness of about 13 mil preferred for some pads. (However, the damping pad 967 may be from 1 mil thick to about the thickness of the hole 948 in the polishing pad 903). The damping pad 967 is secured to the puck 946 with a layer 968 of glue or other adhesive that has a thickness along axis 944 of about 5 mil, though the adhesive layer 968 may be thicker or thinner. Prototypes combining a 40 Shore A latex damping pad with a 90 Shore A optical assembly (secured by a 5 mil thick glue layer) provide significant vibration reduction during wafer polishing.

The damping pad 967 is generally a discrete disk or pad which is glued onto the bottom surface of the optical assembly, though the damping pad may have different shapes. The damping pad 967 may also be in a liquid form that is brushed, painted, or molded onto the optical assembly. In addition, the pad may comprise multiple, discrete layers of different materials and glues.

Another method of reducing vibrations of the optical assembly during CMP is to increase the thickness, along axis 944, of at least a portion of the flange 947, pad, or extension. For example, in one embodiment the thickness of the flange between the shim 954 and the optical assembly 946 may be increased. In another embodiment the thickness of the flange between the bead of glue 951 and the optical assembly 946, may be increased. In addition, vibrations of the optical assembly may be still further reduced by both providing a damping pad 967 and increasing the thickness of at least a portion of the flange 947.

While the above is a full description of the specific embodiments, various modifications, alternative constructions and equivalents known to those of ordinary skill in the relevant arts may be used. For example, while the description above is in terms of a semiconductor wafer, it would be possible to implement the present invention with almost any type of article having a surface or the like. Therefore, the above description and illustrations should not be taken as limiting the scope of the present invention which is defined by the appended claims.

What is claimed is:

1. A method of planarizing an object, the method comprising:

polishing a surface of the object to be planarized using a polishing pad having a cavity;

directing an incident light from a light source disposed in the cavity of the polishing pad to optically measure feature heights of surface features on the surface of the object to obtain measurement data during the polishing of the surface using the polishing pad, the feature heights being relative height differences of the features measured by directing the incident light at the surface of the object from the light source disposed in the cavity and observing a reflected light intensity of a reflected light from the features on the surface to the cavity.

2. The method of claim 1 wherein the polishing pad is larger in surface area than the surface of the object.

3. The method of claim 1 wherein the incident light is directed at the surface at an angle smaller than 90 degrees.

4. The method of claim 3 wherein the angle and wavelength of the incident light are selected based on the surface features.

5. The method of claim 1 wherein the feature heights are measured for a plurality of surface features and averaged to produce an average measurement.

6. The method of claim 1 further comprising adjusting, in real time, parameters controlling the polishing of the surface in response to the measurement data.

7. The method of claim 6 wherein the parameters include at least one of a spinning speed of the polishing pad around an axis of the polishing pad in contact with the surface of the object for polishing the surface, a rotational speed of the object around an axis of the object perpendicular to the surface to be planarized, a position of the polishing pad in contact with the surface of the object for polishing the surface, and a force between the polishing pad and the object.

8. The method of claim 1 wherein the reflected light from the features on the surface is oriented generally opposite from the incident light.

9. An apparatus for planarizing an object, the apparatus comprising:

a polishing pad having a cavity extending to a polishing surface used for polishing a surface of the object to be planarized; and an optical assembly disposed in the cavity of the polishing pad, the optical assembly configured to direct an incident light from the cavity to the surface of the object an angle smaller than 90 degrees and to detect a reflected light from the surface of the object to the cavity to obtain optical measurement data.

10. The apparatus of claim 9 wherein the polishing pad is larger in surface area than the surface of the object.

11. The apparatus of claim 9 wherein the reflected light is used to measure feature heights of surface features on the surface of the object.

12. The apparatus of claim 11 wherein the angle and wavelength of the incident light are selected based on the surface features of the object.

13. The apparatus of claim 9 further comprising a controller configured to adjust, in real time, parameters controlling the polishing of the surface in response to the optical measurement data.

14. The apparatus of claim 13 wherein the parameters include at least one of a spinning speed of the polishing pad around an axis of the polishing pad in contact with the surface of the object for polishing the surface, a rotational speed of the object around an axis of the object perpendicular to the surface to be planarized, a position of the polishing pad in contact with the surface of the object for polishing the surface, and a force between the polishing pad and the object.

15. The apparatus of claim 9 wherein the optical assembly includes a surface which is substantially co-planar with the polishing surface of the polishing pad.

16. An apparatus for planarizing an object, the apparatus comprising:

a polishing pad having a cavity extending to a polishing surface used for polishing a surface of the object to be planarized; and an optical assembly disposed in the cavity of the polishing pad, the optical assembly including means for directing an incident light from the cavity of the polishing pad to optically measure feature heights of surface features on the surface of the object to obtain measurement data during the polishing of the surface using the polishing pad, the feature heights being relative height differences of the features measured by directing the incident light at the surface of the object from the cavity and observing a reflected light intensity of a reflected light from the features on the surface to the cavity.

17. The apparatus of claim 16 wherein the polishing pad is larger in surface area than the surface of the object.

18. The apparatus of claim 16 wherein the angle and wavelength of the incident light are selected based on the surface features of the object.

19. The apparatus of claim 16 further comprising a controller configured to adjust, in real time, parameters controlling the polishing of the surface in response to the optical measurement data.

20. The apparatus of claim 19 wherein the parameters include at least one of a spinning speed of the polishing pad around an axis of the polishing pad in contact with the surface of the object for polishing the surface, a rotational speed of the object around an axis of the object perpendicular to the surface to be planarized, a position of the polishing pad in contact with the surface of the object for polishing the surface, and a force between the polishing pad and the object.

* * * * *